US009977353B2

(12) United States Patent
Nishioka et al.

(10) Patent No.: US 9,977,353 B2
(45) Date of Patent: May 22, 2018

(54) ELECTROPHOTOGRAPHIC MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Satoru Nishioka, Suntou-gun (JP); Kazuhiro Yamauchi, Suntou-gun (JP); Masaki Yamada, Mishima (JP); Sosuke Yamaguchi, Susono (JP); Taichi Shintou, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 14/709,155

(22) Filed: May 11, 2015

(65) Prior Publication Data

US 2015/0331340 A1 Nov. 19, 2015

(30) Foreign Application Priority Data

May 15, 2014 (JP) ..... 2014-101637

(51) Int. Cl.
*B05C 1/08* (2006.01)
*G03G 15/02* (2006.01)
(Continued)

(52) U.S. Cl.
CPC ..... *G03G 5/043* (2013.01); *G03G 5/0567* (2013.01); *G03G 5/0575* (2013.01);
(Continued)

(58) Field of Classification Search
None
See application file for complete search history.

(56) References Cited

U.S. PATENT DOCUMENTS 4,415,646 A * 11/1983 Gruber ..... G03G 9/08726 430/108.22
5,162,188 A * 11/1992 Wilson ..... C07C 233/36 430/108.21

(Continued)

FOREIGN PATENT DOCUMENTS

CN 103140810 A 6/2013
JP 2006-189894 A 7/2006
WO WO-2014133526 A1 * 9/2014 ..... G02F 1/167

OTHER PUBLICATIONS

European Search Report dated Oct. 30, 2015 in European Application No. 15167494.2.

(Continued)

*Primary Examiner* — Katie L Hammer
(74) *Attorney, Agent, or Firm* — Fitzpatrick Cella Harper and Scinto

(57) ABSTRACT

The present invention provides an electrophotographic electro-conductive member containing an ion-exchange group structure in an electro-conductive layer, whereby the bleeding of an ionic conductive agent to the surface of the electro-conductive layer is suppressed and reduction in electro-conductivity caused by electrification is low. For this purpose, the electrophotographic member of the present invention is an electrophotographic member having an electro-conductive mandrel and an electro-conductive layer, wherein the electro-conductive layer contains a resin having any one or more of partial structures represented by the specific formulas (1) to (7) in the molecule, and an anion.

4 Claims, 3 Drawing Sheets

(51) Int. Cl.

| | |
|---|---|
| ***G03G 5/043*** | (2006.01) |
| ***G03G 5/05*** | (2006.01) |
| ***G03G 15/08*** | (2006.01) |
| ***G03G 15/16*** | (2006.01) |

(52) U.S. Cl.
CPC ..... *G03G 15/0233* (2013.01); *G03G 15/0818* (2013.01); *G03G 15/1685* (2013.01)

(56) References Cited

U.S. PATENT DOCUMENTS

| | | | | |
|---|---|---|---|---|
| 6,154,625 | A * | 11/2000 | Saiki | G03G 15/0928 399/276 |
| 6,484,007 | B1 * | 11/2002 | Ozeki | G03G 15/0818 399/286 |
| 7,309,558 | B1 * | 12/2007 | Michel | C01B 39/026 307/400 |
| 8,874,012 | B2 | 10/2014 | Yamada et al. | |
| 2012/0091608 | A1 * | 4/2012 | Kawamura | B29C 73/30 264/36.12 |
| 2013/0281275 | A1 | 10/2013 | Nishioka et al. | |
| 2013/0281276 | A1 | 10/2013 | Watanabe et al. | |
| 2014/0221184 | A1 | 8/2014 | Arimura et al. | |
| 2014/0287899 | A1 | 9/2014 | Nishioka et al. | |

OTHER PUBLICATIONS

U.S. Appl. No. 14/708,940, filed May 11, 2015. Inventor: Masaki Yamada, et al.
U.S. Appl. No. 14/715,477, filed May 18, 2015. Inventor: Sosuke Yamaguchi, et al.
U.S. Appl. No. 14/715,033, filed May 18, 2015. Inventor: Sosuke Yamaguchi, et al.

* cited by examiner

ELECTROPHOTOGRAPHIC MEMBER, PROCESS CARTRIDGE AND ELECTROPHOTOGRAPHIC IMAGE FORMING APPARATUS

BACKGROUND OF THE INVENTION

Field of the Invention

The present invention relates to an electrophotographic member, a process cartridge and an electrophotographic image forming apparatus.

Description of the Related Art

Electro-conductive members such as charging rollers, developing rollers, and transfer rollers are used in electrophotographic apparatuses, which are image forming apparatuses based on an electrophotographic method.

These electro-conductive members require their electrical resistance values to be controlled at $10^3$ to $10^{10}\Omega$ without depending on use conditions and usage environments. In this respect, an electro-conductive member having an electro-conductive layer rendered electro-conductive using an ionic conductive agent such as a quaternary ammonium salt compound is known.

Such an ionic conductive agent may be oozed (hereinafter, this oozing is also referred to as "bleeding") to the surface of the member with time or in a high-temperature and high-humidity environment. The ionic conductive agent thus oozed causes change in outer diameter dimension, stains on the surface of the member, deterioration in adhesive properties, and poor images resulting from the contamination of the surface of other members contacted therewith. In addition, the ionic conductive agent may be ionized into anion components and cation components due to electrification so that these ions are moved and thereby maldistributed, leading to reduction in electro-conductivity.

As a unit for suppressing the bleeding of the ionic conductive agent and reduction in electro-conductivity caused by electrification, Japanese Patent Application Laid-Open No. 2006-189894 discloses that a quaternary ammonium salt in which any one of 4 alkyl groups bonded to the nitrogen atom of the quaternary ammonium salt is an octyl group, and the remaining 3 groups are methyl groups is used as the ionic conductive agent. Use of this ionic conductive agent, even added in a small amount, can achieve the lowering of resistance and is therefore less likely to cause the bleeding of the ionic conductive agent to the surface.

According to the studies of the present inventors, however, the electro-conductive layer rendered electro-conductive using an ionic conductive agent is still desired to achieve higher levels of the control of the bleeding of the ionic conductive agent and time-dependent change in electro-conductivity.

Particularly, with the recent speed-up and enhanced minuteness of electrophotographic apparatuses, higher voltage is applied to electro-conductive members and thus tends to cause the bleeding of the ionic conductive agent and time-dependent change in electro-conductivity.

SUMMARY OF THE INVENTION

The present invention is directed to providing an electrophotographic electro-conductive member containing an ion-exchange group structure in an electro-conductive layer, whereby the bleeding of an ionic conductive agent to the surface of the electro-conductive layer is suppressed and reduction in electro-conductivity caused by electrification is low.

Further, the present invention is directed to providing an electrophotographic image forming apparatus and a process cartridge that can form high-quality electrophotographic images over a long period.

According to one aspect of the present invention, there is provided an electrophotographic member having an electro-conductive mandrel and an electro-conductive layer, wherein the electro-conductive layer contains a resin having any one or more of partial structures represented by the following formulas (1) to (7) in the molecule, and an anion:

Formula (1)

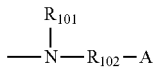

wherein $R_{101}$ represents a hydrogen atom or an alkyl group having 1 to 3 carbon atoms, $R_{102}$ represents $C_mH_{2m}$ (wherein m is 2 to 16) or $(C_2H_4O)_1C_2H_4$ (wherein 1 is 1 to 8), and A represents the following structural formula:

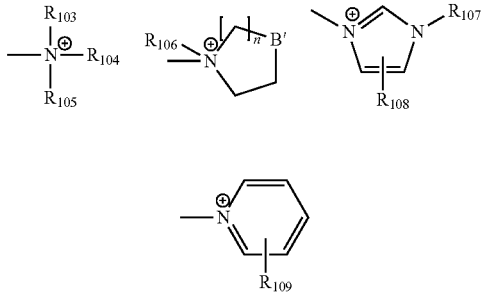

wherein $R_{103}$ to $R_{109}$ each independently represent an alkyl group having 1 to 18 carbon atoms, n represents 1 or 2, and B' represents a methylene group or an oxygen atom;

Formula (2)

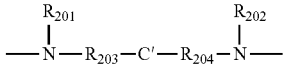

wherein $R_{201}$ and $R_{202}$ each independently represent a hydrogen atom or an alkyl group having 1 to 3 carbon atoms, $R_{203}$ and $R_{204}$ each independently represent $C_mH_{2m}$ (wherein m is 2 to 16) or $(C_2H_4O)_1C_2H_4$ (wherein 1 is 1 to 8), and, C' represents the following structural formula:

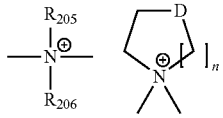

wherein $R_{205}$ and $R_{206}$ each independently represent an alkyl group having 1 to 18 carbon atoms, n represents 1 or 2, and D represents a methylene group or an oxygen atom;

Formula (3)

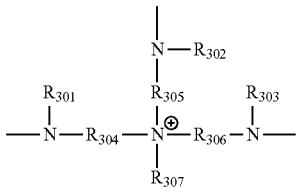

wherein $R_{301}$ to $R_{303}$ each independently represent a hydrogen atom or an alkyl group having 1 to 3 carbon atoms, $R_{304}$ to $R_{306}$ each independently represent $C_mH_{2m}$ (wherein m is 2 to 16) or $(C_2H_4O)_1C_2H_4$ (wherein 1 is 1 to 8), and $R_{307}$ represents an alkyl group having 1 to 18 carbon atoms;

Formula (4)

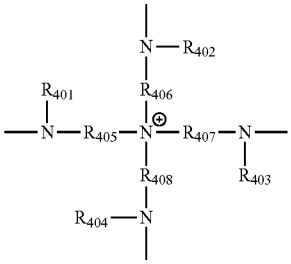

wherein $R_{401}$ to $R_{404}$ each independently represent a hydrogen atom or an alkyl group having 1 to 3 carbon atoms, and $R_{405}$ to $R_{408}$ each independently represent $C_mH_{2m}$ (wherein m is 2 to 16) or $(C_2H_4O)_1C_2H_4$ (wherein 1 is 1 to 8);

Formula (5)

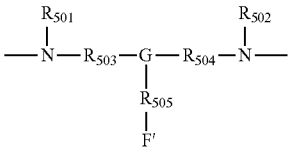

wherein $R_{501}$ and $R_{502}$ each independently represent a hydrogen atom or an alkyl group having 1 to 3 carbon atoms, $R_{503}$ to $R_{505}$ each independently represent $C_mH_{2m}$ (wherein m is 2 to 16) or $(C_2H_4O)_1C_2H_4$ (wherein 1 is 1 to 8), G represents a nitrogen atom or a methine group, and F' represents the following structural formula:

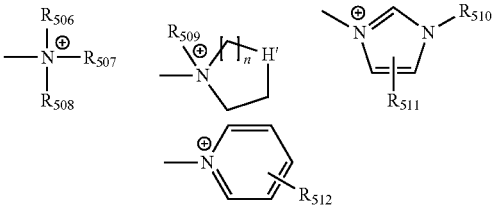

wherein $R_{506}$ to $R_{512}$ each independently represent an alkyl group having 1 to 18 carbon atoms, n represents 1 or 2, and H' represents a methylene group or an oxygen atom;

Formula (6)

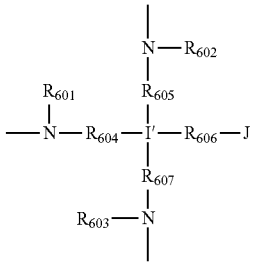

wherein $R_{601}$ to $R_{603}$ each independently represent a hydrogen atom or an alkyl group having 1 to 3 carbon atoms, $R_{604}$ to $R_{607}$ each independently represent $C_mH_{2m}$ (wherein m is 2 to 16) or $(C_2H_4O)_1C_2H_4$ (wherein 1 is 1 to 8), I' represents a nitrogen cation or a carbon atom, and J represents the following structural formula:

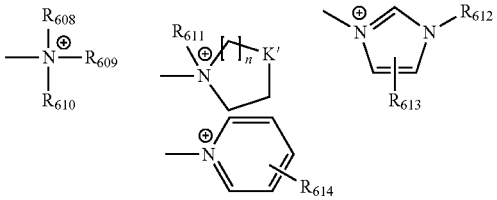

wherein $R_{608}$ to $R_{614}$ each independently represent an alkyl group having 1 to 18 carbon atoms, n represents 1 or 2, and K' represents a methylene group or an oxygen atom; and Formula (7)

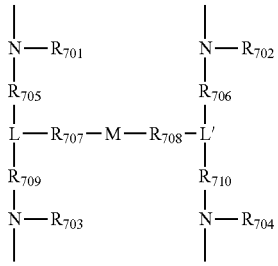

wherein $R_{701}$ to $R_{704}$ each independently represent a hydrogen atom or an alkyl group having 1 to 3 carbon atoms, $R_{705}$ to $R_{710}$ each independently represent $C_mH_{2m}$ (wherein m is 2 to 16) or $(C_2H_4O)_1C_2H_4$ (wherein 1 is 1 to 8), L and L' each represent a nitrogen atom or a methine group, and M represents the following structural formula:

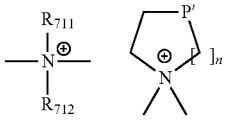

wherein $R_{711}$ and $R_{712}$ each independently represent an alkyl group having 1 to 16 carbon atoms, n represents 1 or 2, and P' represents a methylene group or an oxygen atom.

According to another aspect of the present invention, there is provided a process cartridge having a charging member and an electrophotographic photosensitive member disposed in contact with the charging member, the process cartridge being configured to be attachable to and detachable from the main body of an electrophotographic apparatus, wherein the charging member is the aforementioned electrophotographic member.

According to further aspect of the present invention, there is provided an electrophotographic image forming apparatus having a charging member and an electrophotographic photosensitive member disposed in contact with the charging member, wherein the charging member is the aforementioned electrophotographic member.

According to the present invention, an electrophotographic member whereby the bleeding of an ionic conductive agent and reduction in electro-conductivity caused by electrification can be suppressed can be obtained.

According to the present invention, an electrophotographic image forming apparatus and a process cartridge that can stably form high-quality electrophotographic images can be obtained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present inventors have synthesized a binder resin in an electro-conductive layer from an ionic conductive agent having an amino group and a compound capable of reacting with an amino group and found that the bleeding of the ionic conductive agent and change in electro-conductivity caused by electrification are suppressed by the bonding of a quaternary ammonium salt structure to the binder resin.

The present inventors have estimated the reason why the aforementioned configuration produces the effects of interest, as follows: an ionic conductive agent containing a cation and an anion is probably present as counterions through Coulomb's force. Specifically, when an ionic conductive agent bleeds to the surface of the electro-conductive layer, its cation and anion both bleed to the surface. However, when the cation is bonded to a binder resin, the cation cannot be moved. As a result, the anion cannot be moved from the vicinity of the cation. Hence, it is believed that the bleeding of the ionic conductive agent is suppressed. The reduction in electro-conductivity caused by electrification is probably because the anion and the cation are moved as charge carriers toward electric fields having opposite polarities and maldistributed, leading to the elevation of resistance of the binder resin itself. When the cation is bonded to the binder resin, the cation can be neither moved nor maldistributed even at the time of electrification. Hence, it is believed that the electrical resistance of the binder resin does not vary, and degradation caused by electrification can thus be suppressed unless a movable anion is consumed.

Figure 1A:
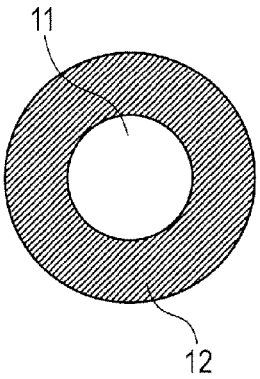
FIGS. 1A, 1B and 1C are schematic cross-sectional views illustrating one example of the electrophotographic member according to the present invention.
Figure 1B:
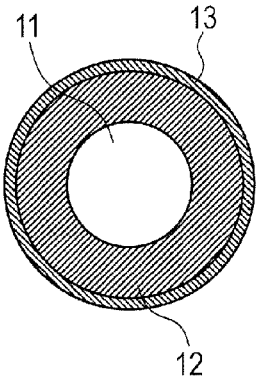

Hereinafter, the present invention will be described in detail. The details of a charging roller and a developing roller will be described as examples of the electrophotographic member. However, use of the electrophotographic member according to the present invention is not intended to be limited to the charging roller or the developing roller. FIGS. 1A and 1B are schematic views illustrating the charging roller and the developing roller of the present invention.

The charging roller according to the present invention, as illustrated in FIG. 1A, can have a mandrel 11 as an electro-conductive mandrel and an elastic layer 12 disposed on the outer circumference thereof. The elastic layer 12 is an electro-conductive layer made of the binder resin according to the present invention. As illustrated in FIG. 1B, a surface layer 13 may be formed on the surface of the elastic layer 12. In this case, at least either of the elastic layer 12 or the surface layer 13, or both are the electro-conductive layer made of the resin according to the present invention and may be used in combination with an electro-conductive layer other than the electro-conductive layer of the present invention.

Figure 1C:
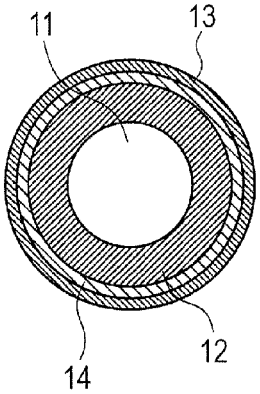

As illustrated in FIG. 1C, a 3-layer configuration having an intermediate layer 14 disposed between the elastic layer 12 and the surface layer 13, or a multilayer configuration having a plurality of intermediate layers 14 disposed therebetween may be used. In this case, at least one of the elastic layer 12, the intermediate layer(s) 14, and the surface layer 13 is the electro-conductive layer containing the resin according to the present invention and may be used in combination with an electro-conductive layer other than the electro-conductive layer of the present invention.

<Electro-Conductive Mandrel>

The electro-conductive mandrel used can be appropriately selected from those known in the field of electrophotographic members. The electro-conductive mandrel is, for example, a carbon steel alloy cylinder provided with nickel plating of approximately 5 μm in thickness on its surface.

<Electro-Conductive Layer>

<Resin Having any One or More of Structures Represented by Formulas (1) to (7) in Molecule>

The resin according to the present invention will be described.

(Formula 1)

The structure of the formula (1) contained in the resin according to the present invention is shown below.

Formula (1)

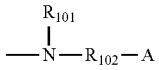

In the formula (1), $R_{101}$ represents a hydrogen atom or an alkyl group having 1 to 3 carbon atoms, $R_{102}$ represents $C_mH_{2m}$ (wherein m is 2 to 16) or $(C_2H_4O)_1C_2H_4$ (wherein 1 is 1 to 8), and A represents the following structural formula:

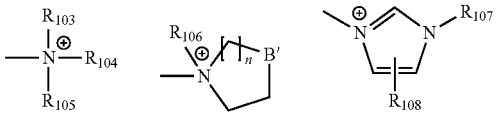

-continued

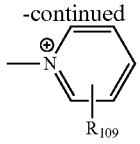

In this context, $R_{103}$ to $R_{109}$ each independently represent an alkyl group having 1 to 18 carbon atoms, n represents 1 or 2, and B' represents a methylene group or an oxygen atom.

For obtaining the resin having the partial structure represented by the formula (1), it is important to obtain a binder resin bonded to a quaternary ammonium salt structure through the reaction of a raw binder resin with an ionic conductive agent having an amino group. In this context, the reaction site between the raw binder resin and the ionic conductive agent is the nitrogen atom. $R_{101}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, $R_{102}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity.

The quaternary ammonium cation structure can be a structure represented by A. $R_{103}$ to $R_{109}$ can be each independently an alkyl group having 1 to 18 carbon atoms, n can be 1 or 2, and B' can be a methylene group or an oxygen atom, because high electro-conductivity, easy synthesis, and compatibility with the binder resin can be attained without inhibiting the reaction with the binder resin.

(Formula 2)

The structure of the formula (2) contained in the resin according to the present invention is shown below.

Formula (2)

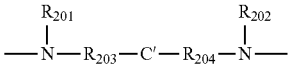

In the formula (2), $R_{201}$ and $R_{202}$ each independently represent a hydrogen atom or an alkyl group having 1 to 3 carbon atoms, $R_{203}$ and $R_{204}$ each independently represent $C_mH_{2m}$ (wherein m is 2 to 16) or $(C_2H_4O)_1C_2H_4$ (wherein 1 is 1 to 8), and C' represents the following structural formula:

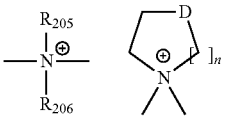

In the formula, $R_{205}$ and $R_{206}$ each independently represent an alkyl group having 1 to 18 carbon atoms, n represents 1 or 2, and D represents a methylene group or an oxygen atom.

For obtaining the resin having the partial structure represented by the formula (2), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{201}$ and $R_{202}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{203}$ and $R_{204}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity.

The quaternary ammonium cation structure can be a structure represented by C. $R_{205}$ and $R_{206}$ can be each independently an alkyl group having 1 to 18 carbon atoms, n can be 1 or 2, and D can be a methylene group or an oxygen atom, because high electro-conductivity, easy synthesis, and compatibility with the binder resin can be attained without inhibiting the reaction with the binder resin.

(Formula 3)

The structure of the formula (3) contained in the resin according to the present invention is shown below.

Formula (3)

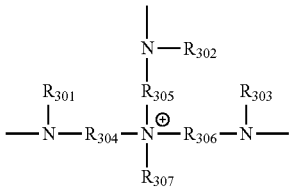

In the formula (3), $R_{301}$ to $R_{303}$ each independently represent a hydrogen atom or an alkyl group having 1 to 3 carbon atoms, $R_{304}$ to $R_{306}$ each independently represent $C_mH_{2m}$ (wherein m is 2 to 16) or $(C_2H_4O)_1C_2H_4$ (wherein 1 is 1 to 8), and $R_{307}$ represents an alkyl group having 1 to 18 carbon atoms.

For obtaining the resin having the partial structure represented by the formula (3), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{301}$ to $R_{303}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{304}$ to $R_{306}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity.

$R_{307}$ can be an alkyl group having 1 to 18 carbon atoms, because high electro-conductivity, easy synthesis, and compatibility with the binder resin can be attained without inhibiting the reaction with the binder resin.

(Formula 4)

The structure of the formula (4) contained in the resin according to the present invention is shown below.

Formula (4)

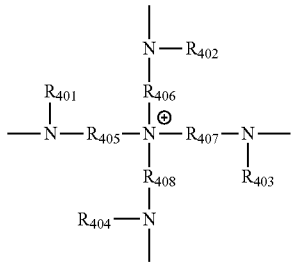

In the formula (4), $R_{401}$ to $R_{404}$ each independently represent a hydrogen atom or an alkyl group having 1 to 3 carbon atoms, and $R_{405}$ to $R_{408}$ each independently represent $C_mH_{2m}$ (wherein m is 2 to 16) or $(C_2H_4O)_1C_2H_4$ (wherein 1 is 1 to 8).

For obtaining the resin having the partial structure represented by the formula (4), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{401}$ to $R_{404}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{405}$ to $R_{408}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity.

(Formula 5)

The structure of the formula (5) contained in the resin according to the present invention is shown below.

Formula (5)

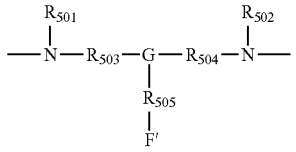

In the formula (5), $R_{501}$ and $R_{502}$ each independently represent a hydrogen atom or an alkyl group having 1 to 3 carbon atoms, $R_{503}$ to $R_{505}$ each independently represent $C_mH_{2m}$ (wherein m is 2 to 16) or $(C_2H_4O)_1C_2H_4$ (wherein 1 is 1 to 8), G represents a nitrogen atom or a methine group, and F' represents the following structural formula:

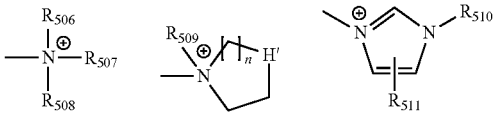

-continued

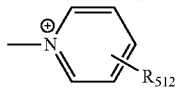

In this context, $R_{506}$ to $R_{512}$ each independently represent an alkyl group having 1 to 18 carbon atoms, n represents 1 or 2, and H' represents a methylene group or an oxygen atom.

For obtaining the resin having the partial structure represented by the formula (5), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{501}$ and $R_{502}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{503}$ to $R_{505}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity. G can be a nitrogen atom or a methine group, because easy synthesis is attained.

The quaternary ammonium cation structure can be a structure represented by F'. $R_{506}$ to $R_{512}$ can be each independently an alkyl group having 1 to 18 carbon atoms, n can be 1 or 2, and H can be a methylene group or an oxygen atom, because high electro-conductivity, easy synthesis, and compatibility with the binder resin can be attained without inhibiting the reaction with the binder resin.

(Formula 6)

The structure of the formula (6) contained in the resin according to the present invention is shown below.

Formula (6)

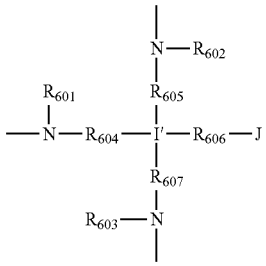

In the formula (6), $R_{601}$ to $R_{603}$ each independently represent a hydrogen atom or an alkyl group having 1 to 3 carbon atoms, $R_{604}$ to $R_{607}$ each independently represent $C_mH_{2m}$ (wherein m is 2 to 16) or $(C_2H_4O)_1C_2H_4$ (wherein 1 is 1 to 8), I' represents a nitrogen cation or a carbon atom, and J represents the following structural formula:

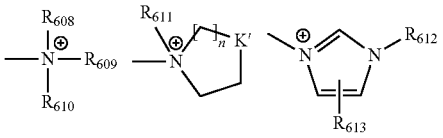

-continued

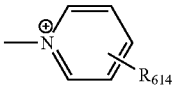

In this context, $R_{608}$ to $R_{614}$ each independently represent an alkyl group having 1 to 18 carbon atoms, n represents 1 or 2, and K' represents a methylene group or an oxygen atom.

For obtaining the resin having the partial structure represented by the formula (6), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{601}$ to $R_{603}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{604}$ to $R_{607}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity. I' can be a nitrogen cation or a carbon atom, because easy synthesis is attained.

The quaternary ammonium cation structure can be a structure represented by J. $R_{608}$ to $R_{614}$ can be each independently an alkyl group having 1 to 18 carbon atoms, n can be 1 or 2, and G can be a methylene group or an oxygen atom, because high electro-conductivity, easy synthesis, and compatibility with the binder resin can be attained without inhibiting the reaction with the binder resin.

(Formula 7)

The structure of the formula (7) contained in the resin according to the present invention is shown below.

Formula (7)

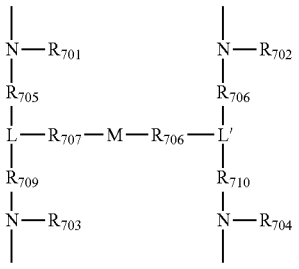

In the formula (7), $R_{701}$ to $R_{704}$ each independently represent a hydrogen atom or an alkyl group having 1 to 3 carbon atoms, $R_{705}$ to $R_{710}$ each independently represent $C_mH_{2m}$ (wherein m is 2 to 16) or $(C_2H_4O)_lC_2H_4$ (wherein l is 1 to 8), L and L' each independently represent a nitrogen atom or a methine group, and M represents the following structural formula:

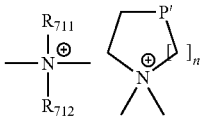

In this context, $R_{711}$ and $R_{712}$ each independently represent an alkyl group having 1 to 18 carbon atoms, n represents 1 or 2, and, P' represents a methylene group or an oxygen atom.

For obtaining the resin having the partial structure represented by the formula (7), it is important to obtain a binder resin bonded to a quaternary ammonium salt structure through the reaction of a raw binder resin with an ionic conductive agent having an amino group. In this context, the reaction site between the raw binder resin and the ionic conductive agent is each nitrogen atom. Each of $R_{701}$ to $R_{704}$ bonded to this nitrogen atom can therefore be a hydrogen atom or an alkyl group having 1 to 3 carbon atoms in order to suppress steric hindrance and to enhance the reactivity between the ionic conductive agent and the raw binder resin. Also, each of $R_{705}$ to $R_{710}$ can be an alkyl chain having 1 to 12 carbon atoms or an ethylene oxide chain having 1 to 8 repeating units from the viewpoint of the reactivity between the raw binder resin and the ionic conductive agent, and electro-conductivity. This range does not inhibit the reactivity of the ionic conductive agent with the raw binder resin and also yields adequate electro-conductivity. L and 0 can be each independently a nitrogen atom or a methine group, because easy synthesis is attained.

The quaternary ammonium cation structure can be a structure represented by M. $R_{711}$ and $R_{712}$ can be each independently an alkyl group having 1 to 18 carbon atoms, n can be 1 or 2, and P can be a methylene group or an oxygen atom, because high electro-conductivity, easy synthesis, and compatibility with the binder resin can be attained without inhibiting the reaction with the binder resin.

In the resin according to the present invention, a larger number of nitrogen atoms bonded to the binder resin tends to suppress bleeding and change in electro-conductivity caused by electrification. This is probably because the quaternary ammonium salt is more firmly anchored in the binder resin. As for the electro-conductivity, a partial structure containing the quaternary ammonium salt structure in the binder resin side chain tends to exhibit higher electro-conductivity than that of a partial structure containing the quaternary ammonium salt structure in the binder resin backbone. This is probably due to the high mobility of the quaternary ammonium salt structure. Specifically, the structure of the formula (5) or (6) in which a plurality of nitrogen atoms are bonded to the binder resin and the quaternary ammonium salt structure is present in the binder resin side chain can suppress bleeding and change in electro-conductivity caused by electrification while maintaining high electro-conductivity.

The resin according to the present invention is produced using at least one ionic conductive agent having a primary or secondary amino group and a binder resin synthesized from a compound capable of reacting with an amino group.

The compound capable of reacting with an amino group is selected from known compounds generally used. Specific examples thereof include, but are not limited to, polyisocyanate compounds, polyepoxy compounds, polycarboxylic acid compounds, polyacid halides, polyacid anhydride compounds, polyaldehyde compounds, polyketone compounds, polyhalides and poly-α,β unsaturated carbonyl compounds.

Also, the binder resin may be produced through Strecker reaction, Mannich reaction, Betti reaction or the like, which forms a covalent bond with an amino group through the three-component reaction of an amine compound, aldehyde and a nucleophilic reagent.

The compound capable of reacting with an amino group is preferably an isocyanate compound, an epoxy compound, a carboxylic acid compound, an acid halide or a halogen compound, more preferably an isocyanate compound or an epoxy compound. The binder resin obtained through the reaction of any of these compounds with the ionic conductive agent having a primary or secondary amino group is low resistant and also chemically stable.

The structure of a binding site resulting from the reaction of each compound (raw binder resin) with the ionic conductive agent having a primary or secondary amino group is shown below. Specifically, in the resin according to the present invention having the introduced ionic conductive agent, the ionic conductive agent is preferably bonded to the molecular chain of the binder resin via any of structures represented by the following formulas (8) to (11), and the ionic conductive agent is more preferably bonded to the molecular chain of the binder resin via a structure represented by the following formula (8) or (9):

Formula (8)

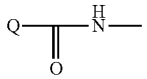

Formula (9)

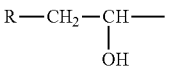

Formula (10)

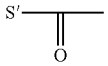

Formula (11)

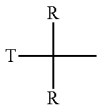

In the formulas (8) to (11), Q, R, S' and T each independently represent any of the structures of the formulas (1) to (7). The formula (8) represents a structure formed through the reaction between the amino group carried by the ionic conductive agent mentioned later and a NCO group carried by an isocyanate compound. The formula (9) represents a structure formed through the reaction between the amino group carried by the ionic conductive agent mentioned later and a glycidyl group carried by an epoxy compound. The formula (10) represents a structure formed through the reaction between the amino group carried by the ionic conductive agent mentioned later and a carboxyl group, a carboxylic anhydride group or a carboxylic acid halogen group carried by a carboxylic acid, a carboxylic anhydride or a carboxylic acid halide. The formula (11) represents a structure of the binding site resulting from the substitution reaction between the amino group carried by the ionic conductive agent and a halogen atom carried by a halide.

An approach of synthesizing a binder from an ionic conductive agent having a hydroxy group instead of an amino group and a compound capable of reacting with a hydroxy group is known as a unit for bonding the ionic conductive agent to the binder resin. Since the binder synthesized using an amino group often permits mild synthesis conditions such as reaction time and reaction temperature compared with the binder synthesized using a hydroxy group, a resin layer that is more insusceptible to bleeding and has higher mechanical strength can be prepared with the degradation of the binder resin suppressed.

A binder resin containing a nitrogen atom derived from the ionic conductive agent at the binding site exhibits low resistance and the minimum elevation of resistance caused by electrification compared with a binder resin having an oxygen atom derived from the ionic conductive agent at the binding site. Although the reason therefor is uncertain, the nitrogen atom may contribute to the dissociation of the ionic conductive agent.

(Raw Binder Resin)

The raw binder resin is not particularly limited as long as the raw binder resin is synthesized from a compound that reacts with the amino group contained in the ionic conductive agent. Examples thereof include, but are not limited to, epoxy resin, urethane resin, urea resin, polyamide resin, phenol resin, acrylic resin, vinyl resin and epichlorohydrin rubber.

The binder resin according to the present invention can be produced through the reaction between the aforementioned raw material ionic conductive agent and raw binder resin.

The binder resin can contain an alkylene oxide structure in order to decrease an electrical resistance value in a low-temperature and low-humidity environment. Specific examples of the alkylene oxide structure include ethylene oxide, propylene oxide, butylene oxide and α-olefin oxide. These alkylene oxide structures can be used alone or in combination according to the need. Among these alkylene oxides, particularly, ethylene oxide can be used from the viewpoint of ion dissociation to lower resistance in a low-temperature and low-humidity environment.

The raw binder resin can be urethane resin or epoxy resin from the viewpoint of resistance control, reactivity and mechanical properties.

(Urethane Resin)

[Polyol Compound]

The urethane resin raw material polyol is selected from known compounds generally used in electrophotographic members. Specifically, polyether polyol, polyester polyol, polycarbonate polyol or the like can be used. The polyol is more preferably polyether polyol having an alkylene oxide structure that can decrease an electrical resistance value in a low-temperature and low-humidity environment, as mentioned above. Specific examples of the alkylene oxide structure include ethylene oxide, propylene oxide, butylene oxide and α-olefin oxide. These alkylene oxide structures can be used alone or in combination according to the need. Among these alkylene oxides, particularly, ethylene oxide can be used from the viewpoint of electro-conductivity to lower resistance in a low-temperature and low-humidity environment.

[Isocyanate Compound]

The urethane resin raw material polyisocyanate compound is selected from known compounds generally used. Specifically, toluene diisocyanate (TDI), diphenylmethane diisocyanate (MDI), hydrogenated MDI, xylylene diisocyanate (XDI), hexamethylene diisocyanate (HDI), isophorone diisocyanate (IPDI) or the like can be used.

(Epoxy Resin)

[Epoxy Compound]

The epoxy resin raw material polyepoxy compound is selected from known compounds generally used. Specifically, a glycidyl ether epoxy compound, a glycidyl ester epoxy compound, a glycidylamine epoxy compound, olefin oxidation-based epoxy resin or the like can be used. The polyepoxy compound can be polyglycidyl ether having an alkylene oxide structure that can decrease an electrical resistance value in a low-temperature and low-humidity environment, as mentioned above. Specific examples of the alkylene oxide structure include ethylene oxide, propylene oxide, butylene oxide and α-olefin oxide. These alkylene oxide structures can be used alone or in combination according to the need. Among these alkylene oxides, particularly, ethylene oxide can be used from the viewpoint of electroconductivity to lower resistance in a low-temperature and low-humidity environment.

[Curing Agent]

The epoxy resin raw material curing agent is selected from known curing agents generally used. Specifically, polyamine, polyamidoamine, a compound containing a phenolic hydroxy group, polythiol, acid anhydride, polyhydrazide, a cation polymerization initiator or the like is used. The curing agent can be polyamine having an alkylene oxide structure that can decrease an electrical resistance value in a low-temperature and low-humidity environment, as mentioned above. Specific examples of the alkylene oxide structure include ethylene oxide, propylene oxide, butylene oxide and α-olefin oxide. These alkylene oxide structures can be used alone or in combination according to the need. Among these alkylene oxides, particularly, ethylene oxide can be used from the viewpoint of electro-conductivity to lower resistance in a low-temperature and low-humidity environment.

Whether or not the partial structure according to the present invention is bonded in the binder resin can be confirmed by the following method: a portion of the electroconductive layer is excised and subjected to Soxhlet extraction procedures for 1 week using a hydrophilic solvent such as ethanol. The binder resin thus extracted can be analyzed by infrared spectroscopy (IR) to confirm the presence or absence of the linkage of the partial structure. Likewise, the obtained extract and extraction residues can be analyzed by solid $^{13}$C-NMR assay and mass spectrometry using a time-of-flight mass spectrometer (TOF-MS) to measure the partial structure and anions.

<Ionic Conductive Agent Having a Primary or Secondary Amino Group>

The ionic conductive agent as the raw material of the present invention is an ionic conductive agent having a primary or secondary amino group that reacts with the binder resin, and a quaternary ammonium group. Although an ionic conductive agent having a hydroxy group is also known as another ionic conductive agent capable of binding to a binder, the hydroxy group may be low reactive compared with an amino group and is capable of binding to a limited number of resins. For these reasons, the ionic conductive agent having a primary or secondary amino group is preferred. The typical structure of this ionic conductive agent is described below. However, the present invention is not intended to be limited by an electrophotographic member produced using the ionic conductive agent described herein.

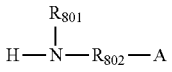

Ionic Conductive Agent (I)

In this context, $R_{801}$ represents a hydrogen atom or an alkyl group, and $R_{802}$ represents an alkylene group or an alkylene oxide structure. A is a quaternary ammonium cation and represents the following structural formula:

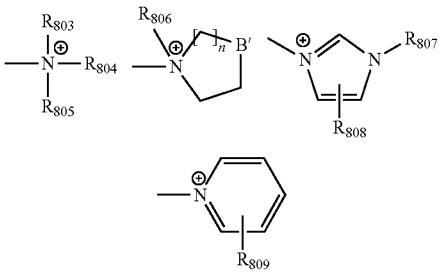

In this context, $R_{803}$ to $R_{809}$ each independently represent an alkyl group, n represents 1 or 2, and B' represents a methylene group or an oxygen atom.

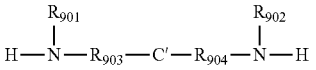

Ionic Conductive Agent (II)

In this context, $R_{901}$ and $R_{902}$ each independently represent a hydrogen atom or an alkyl group, and $R_{903}$ and $R_{904}$ each independently represent an alkylene group or an alkylene oxide structure. C' is a quaternary ammonium cation and represents the following structural formula:

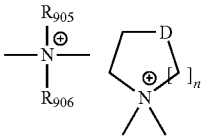

In this context, $R_{905}$ to $R_{906}$ each independently represent an alkyl group, n represents 1 or 2, and D represents a methylene group or an oxygen atom.

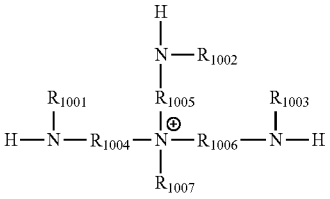

Ionic Conductive Agent (III)

In this context, $R_{1001}$ to $R_{1003}$ each independently represent a hydrogen atom or an alkyl group, $R_{1004}$ and $R_{1006}$ each independently represent an alkylene group or an alkylene oxide structure, and $R_{1007}$ represents an alkyl group having 1 to 18 carbon atoms.

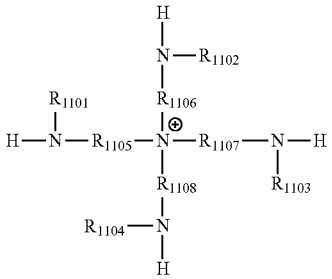

Ionic Conductive Agent (IV)

In this context, $R_{1101}$ to $R_{1104}$ each independently represent a hydrogen atom or an alkyl group, and $R_{1105}$ to $R_{1108}$ each independently represent an alkylene group or an alkylene oxide structure.

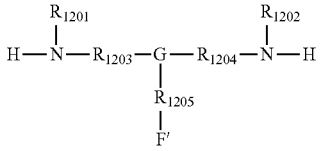

Ionic Conductive Agent (V)

In this context, $R_{1201}$ and $R_{1202}$ each independently represent a hydrogen atom or an alkyl group, $R_{1203}$ to $R_{1205}$ each independently represent an alkylene group or an alkylene oxide structure, and G represents a nitrogen atom or a methine group. F' represents the following structural formula:

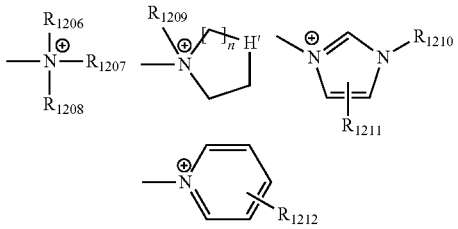

In this context, $R_{1206}$ to $R_{1212}$ each independently represent an alkyl group, n represents 1 or 2, and E represents a methylene group or an oxygen atom.

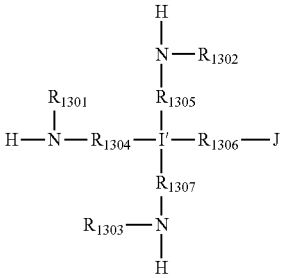

Ionic Conductive Agent (VI)

In this context, $R_{1301}$ to $R_{1303}$ each independently represent a hydrogen atom or an alkyl group, $R_{1304}$ to $R_{1307}$ each independently represent an alkylene group or an alkylene oxide structure, and I' represents a nitrogen cation or a carbon atom. J represents the following structural formula:

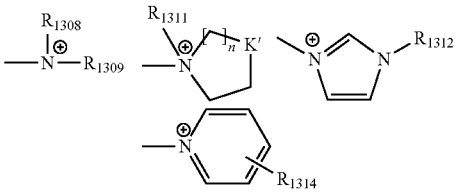

In this context, $R_{1308}$ to $R_{1314}$ each independently represent an alkyl group, n represents 1 or 2, and K' represents a methylene group or an oxygen atom.

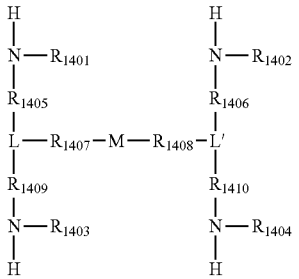

Ionic Conductive Agent (VII)

In this context, $R_{1401}$ to $R_{1404}$ each independently represent a hydrogen atom or an alkyl group, $R_{1405}$ to $R_{1410}$ each independently represent an alkylene group or an alkylene oxide structure, and L and L' each independently represent a nitrogen atom or a methine group. M represents the following structural formula:

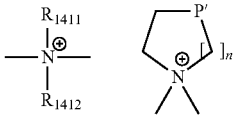

In this context, $R_{1411}$ and $R_{1412}$ each independently represent an alkyl group, n represents 1 or 2, and P' represents a methylene group or an oxygen atom.

<Anion>

Examples of the anion include halogen ions such as fluorine, chlorine, bromine and iodine ions, perchloric acid ions, sulfonic acid compound ions, phosphoric acid compound ions, boric acid compound ions and perfluorosulfonylimide ions.

Among the ion species mentioned above, a perfluorosulfonylimide ion is preferred. The perfluorosulfonylimide ion exhibits higher electro-conductivity than that of other anions and is therefore suitable for exhibiting higher electro-conductivity in a low-temperature and low-humidity environment. In addition, the perfluorosulfonylimide ion has high hydrophobicity and therefore tends to have high affinity for the binder resin raw material according to the present invention compared with general ions having high hydrophilicity. As a result, this ion is uniformly dispersed, reacted, and anchored with the binder resin raw material, and is therefore suitable for further reducing uneven electrical resistance responsible for uneven dispersion.

Specific examples of the perfluorosulfonylimide ion include, but are not limited to, bis(fluorosulfonyl)imide, bis(trifluoromethanesulfonyl)imide, bis(pentafluoromethanesulfonyl)imide, bis(nonafluorobutanesulfonyl)imide and cyclohexafluoropropane-1,3-bis(sulfonyl)imide.

The amount of the ionic conductive agent added can be appropriately set. The ionic conductive agent can be mixed at a ratio of 0.5 parts by mass or larger and 20 parts by mass or smaller to 100 parts by mass of the raw binder resin. The ionic conductive agent mixed in an amount of 0.5 parts by mass or larger can easily produce the effect of conferring electro-conductivity by the addition of the conductive agent. The ionic conductive agent mixed in an amount of 20 parts by mass or smaller can reduce the environment dependence of electrical resistance.

When the ionic conductive resin used in the electrophotographic member of the present invention is used as the elastic layer 12 or the intermediate layer between the elastic layer 12 and the surface layer 13, a layer known in the field of electrophotographic electro-conductive members can be used as the surface layer 13. Specific examples thereof include organic-inorganic hybrid films synthesized from acrylic resin, polyurethane, polyamide, polyester, polyolefin and silicone resin, and metal alkoxide such as tetraethoxysilane.

If necessary, carbon black, graphite, an oxide having electro-conductivity such as tin oxide, a metal such as copper or silver, electro-conductive particles given electro-conductivity by the coating of the particle surface with an oxide or a metal, or an ionic conductive agent having ion-exchange performance such as a quaternary ammonium salt may be used for the resin that forms the surface layer.

A rubber material, a resin material or the like can be used in the electro-conductive resin layer (elastic layer 12).

The rubber material is not particularly limited, and a rubber known in the field of electrophotographic electro-conductive members can be used. Specific examples thereof include epichlorohydrin homopolymer, epichlorohydrin-ethylene oxide copolymer, epichlorohydrin-ethylene oxide-allylglycidyl ether ternary copolymer, acrylonitrile-butadiene copolymer, hydrogenated acrylonitrile-butadiene copolymer, silicone rubber, acrylic rubber and urethane rubber.

A resin known in the field of electrophotographic electro-conductive members can also be used as the resin material. Specific examples thereof include acrylic resin, polyurethane, polyamide, polyester, polyolefin, epoxy resin and silicone resin.

If necessary, carbon black, graphite or an oxide (e.g., tin oxide) exhibiting electronic conductivity, a metal such as copper or silver, electro-conductive particles given electro-conductivity by the coating of the particle surface with an oxide or a metal, or an ionic conductive agent having ion-exchange performance such as a quaternary ammonium salt or sulfonate exhibiting ionic conductivity may be used for the rubber that forms the electro-conductive resin layer, in order to adjust an electrical resistance value. In addition, general agents for use in mixing with resins, such as a filler, a softening agent, a process aid, a tackifier, an anti-tack agent, a dispersant, a foaming agent and surface roughness-imparting particles, can be added without impairing the effects of the present invention. The electrical resistance value of the electro-conductive resin layer according to the present invention can offer resistance to the extent that does not inhibit the resistance range of the present invention.

<Electro-Conductive Roller>

The electrophotographic member according to the present invention can be suitably used as, for example, a charging roller for charging a member to be charged (e.g., an electrophotographic photosensitive member). Also, the electro-conductive member according to the present invention can be suitably used as a charging roller in a process cartridge having an image carrier and the charging roller that is disposed in contact with the image carrier and charges the image carrier by the application of voltage, the process cartridge being configured to be attachable to and detachable from the main body of an electrophotographic image forming apparatus.

The electrophotographic member of the present invention may be used as a developing member, a transfer member, an antistatic member, or a conveying member such as a paper feed roller, in addition to a charging member such as the charging roller.

The electrical resistance value of each layer that forms the electrophotographic member according to the present invention can offer resistance to the extent that does not inhibit the resistance range of the present invention.

<Process Cartridge>

Figure 2:
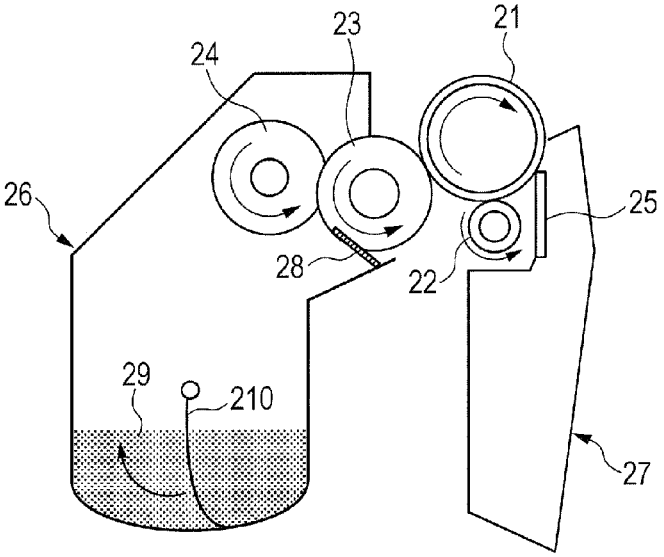
FIG. 2 is an illustration of the process cartridge according to the present invention.

FIG. 2 is a schematic cross-sectional view of the electrophotographic process cartridge according to the present invention.

The process cartridge includes any one or more developing apparatuses and any one or more charging apparatuses. The developing apparatus has at least a developing roller 23 integrally with a toner container 26 and may optionally have a toner supply roller 24, toner 29, a developing blade 28 and a stirring blade 210. The charging apparatus has at least an electrophotographic photosensitive member 21 integrally with a cleaning blade and a charging roller 22 and may have a waste toner container 27. Voltage is applied to each of the charging roller 22, the developing roller 23, the toner supply roller 24 and the developing blade 28.

<Electrophotographic Image Forming Apparatus>

Figure 3:
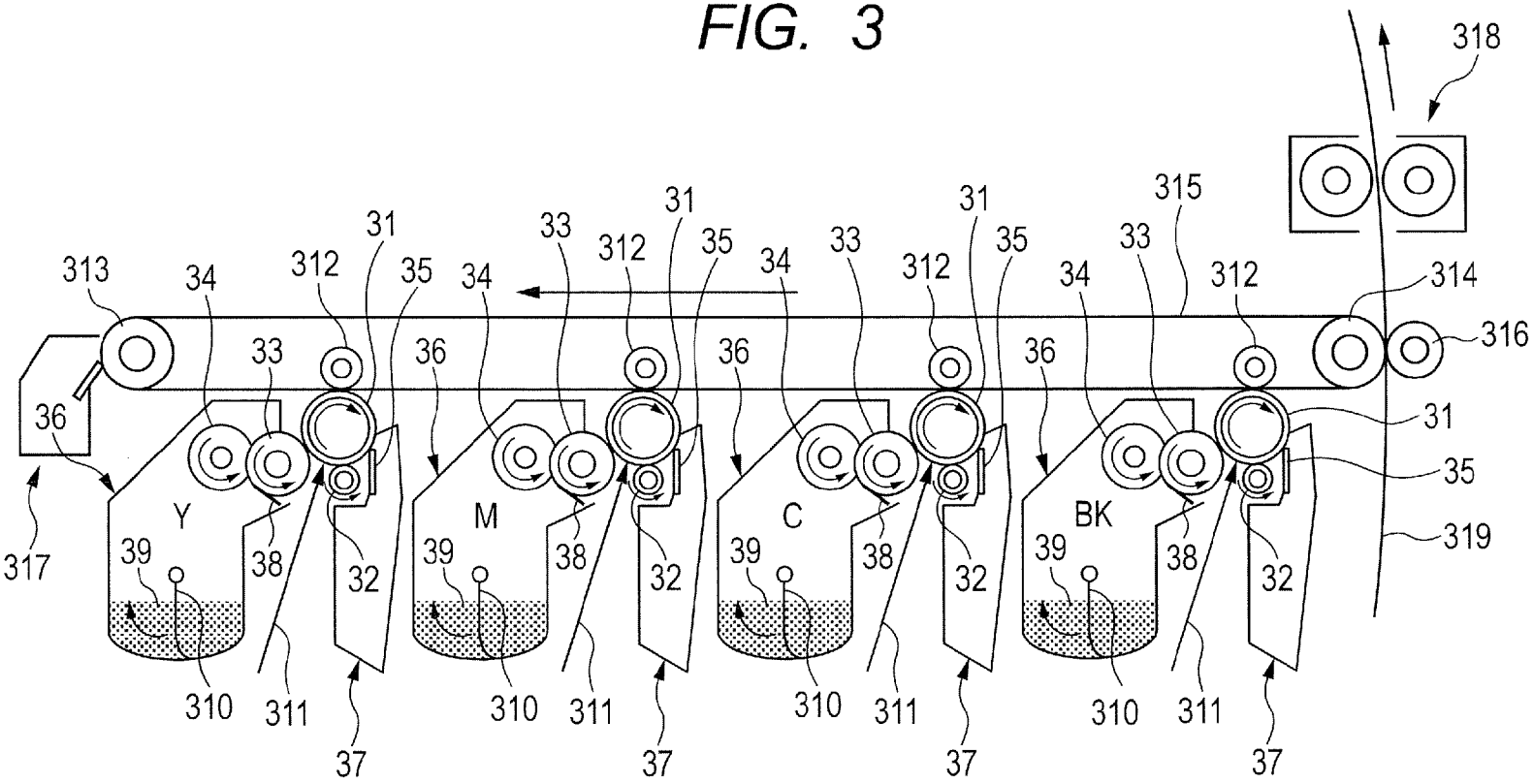
FIG. 3 is an illustration of the electrophotographic apparatus according to the present invention.

FIG. 3 is a schematic configuration diagram of the electrophotographic image forming apparatus according to the present invention. This electrophotographic image forming apparatus is provided with the process cartridge illustrated in FIG. 2 for each toner of, for example, black, magenta, yellow or cyan and serves as a color image forming apparatus to which this cartridge is detachably attached.

A charging roller 32 is disposed in opposition to an electrophotographic photosensitive member 31 and charges the electrophotographic photosensitive member 31. The electrophotographic photosensitive member 31 rotates in the direction indicated by the arrow, and is uniformly charged by the charging roller 32 upon application of voltage from a charging bias supply. An electrostatic latent image is formed on its surface by an exposure light 311. Meanwhile, toner 39 contained in a toner container 36 is supplied to a toner supply roller 34 through a stirring blade 310 and conveyed onto a developing roller 33. Then, the surface of the developing roller 33 is uniformly coated with the toner 39 by a developing blade 38 disposed in contact with the developing roller 33, while the toner 39 is charged by frictional electrification. The electrostatic latent image is developed by the application of the toner 39 conveyed by the developing roller 33 disposed in contact with the photosensitive member 31, and visualized as a toner image.

The visualized toner image on the electrophotographic photosensitive member is transferred to an intermediate transfer belt 315 through a primary transfer roller 312 upon application of voltage from a primary transfer bias supply (not shown). Toner images of respective colors are sequentially superimposed to form a color image on the intermediate transfer belt.

A transfer material 319 is fed into the apparatus through a paper feed roller (not shown) and conveyed to between the intermediate transfer belt 315 and a secondary transfer roller 316. The secondary transfer roller 316 transfers the color image on the intermediate transfer belt 315 to the transfer material 319 upon application of voltage from a secondary transfer bias supply (not shown). The transfer material 319 with the color image transferred thereto is subjected to fixing treatment by a fixing member 318 and discharged from the apparatus to complete the printing operation.

On the other hand, toner that has remained on the electrophotographic photosensitive member without being transferred is collected by scraping by a cleaning blade 35 and housed in a waste toner reservoir 37. The cleaned electrophotographic photosensitive member 31 is repetitively used in the aforementioned process. Toner that has remained on the primary transfer belt without being transferred is also collected by scraping by a cleaning apparatus 317.

Examples

Hereinafter, Examples of the present invention will be described.

<1. Preparation of Unvulcanized Rubber Composition>

Each material of type and amount shown in Table 1 below was mixed using a pressurization-type kneader to obtain kneaded rubber composition A. Further, 166 parts by mass of the kneaded rubber composition A were mixed with each material of type and amount shown in Table 2 below using an open roll to obtain an unvulcanized rubber composition.

TABLE 1

| | Material | Amount mixed (parts by mass) |
|---|---|---|
| Raw rubber | NBR (trade name: Nipol DN219 manufactured by Zeon Corp) | 100 |
| Conductive agent | Carbon black (trade name: Toka Black #7360SB manufactured by Tokai Carbon Co., Ltd.) | 40 |
| Filler | Calcium carbonate (trade name: Nanox #30 manufactured by Maruo Calcium Co., Ltd.) | 20 |
| Vulcanization acceleration aid | Zinc oxide | 5 |
| Process aid | Stearic acid | 1 |

TABLE 2

| | Material | Amount mixed (parts by mass) |
|---|---|---|
| Cross-linking agent | Sulfur | 1.2 |
| Vulcanization accelerator | Tetrabenzylthiuram disulfide (trade name: TBZTD manufactured by Sanshin Chemical Industry Co., Ltd.) | 4.5 |

<2. Preparation of Electro-Conductive Roller>

The electro-conductive roller having an electro-conductive mandrel and an elastic layer according to the present invention was prepared as follows.

The surface of a free-cutting steel was treated with electroless nickel plating to prepare a round rod of 252 mm in full length and 6 mm in outer diameter. Next, an adhesive was applied to the entire circumferential region (230 mm) except for both ends (11 mm each) of the round rod. The adhesive used was of electro-conductive hot melt type. This application was carried out using a roll coater. In this Example, the round rod coated with the adhesive was used as an electro-conductive mandrel.

Next, a crosshead extruder having an electro-conductive mandrel supply mechanism and an unvulcanized rubber roller discharge mechanism was prepared. A die of 12.5 mm in inner diameter was attached to the crosshead. The temperatures of the extruder and the crosshead were set to 80° C., and the convey speed of the electro-conductive mandrel was adjusted to 60 mm/sec. Under this condition, the unvulcanized rubber composition was supplied from the extruder so that the electro-conductive mandrel was coated with the unvulcanized rubber composition in the crosshead to obtain an unvulcanized rubber roller. Subsequently, the unvulcanized rubber roller was charged into a hot-air vulcanization furnace of 170° C. and heated for 60 minutes for the vulcanization of the unvulcanized rubber composition to obtain an unpolished electro-conductive roller having an elastic layer. Then, the ends of the elastic layer were removed by cutting. Finally, the surface of the elastic layer was polished with a grindstone. In this way, an electro-conductive roller having a diameter of 8.4 mm at each position of 90 mm from the central portion to both ends and a diameter of 8.5 mm in the central portion was obtained.

<3. Synthesis of Quaternary Ammonium Salt>

(Synthesis of Ionic Conductive Agent (I))

<Ionic Conductive Agent 1>

(2-Aminoethyl)trimethylammonium chloride hydrochloride (manufactured by Sigma-Aldrich Corp.) was dissolved in ion-exchange water, and the hydrochloric acid was removed using an anion-exchange resin. Then, the ion-exchange water in the solution was distilled off under reduced pressure to obtain ionic conductive agent 1. The structure of the synthesized ionic conductive agent is shown in Table 4.

<Ionic Conductive Agent 2>

2.82 g (10 mmol) of a quaternizing agent N-(4-bromobutyl)phthalimide was dissolved in 10 ml of acetone. To the solution, 3.17 g (15 mmol) of an aqueous solution containing 28% by mass of trimethylamine was added as a tertiary amine at room temperature, and then, the mixture was heated to reflux for 72 hours. Then, the solvent was distilled off under reduced pressure. The obtained concentrate was washed with diethyl ether, and the supernatant was removed by decantation. This operation was repeated three times. Then, the residue was dissolved in 10 ml of ethanol. To the solution, 0.95 g (15 mmol) of hydrazine monohydrate (79%) was added, and the mixture was heated with stirring at 40° C. for 4 hours, then cooled to room temperature, and filtered. The solvent in the filtrate was distilled off under reduced pressure. The anion of the obtained residue was a bromide ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 2 having a bis(trifluoromethanesulfonyl)imide ion (TFSI) as an anion. The structure of the synthesized ionic conductive agent is shown in Table 4.

<Ionic Conductive Agents 3 to 10>

The ionic conductive agents were synthesized in the same way as in the ionic conductive agent 2 except that the quaternizing agent, the tertiary amine and the anion-exchange salt were changed to those described in Table 3. Anion exchange was not performed for the ionic conductive agent 4. The structure of each synthesized ionic conductive agent is shown in Table 4.

TABLE 3

| Ionic conductive agent | Quaternizing agent | Tertiary amine | Anion-exchange salt |
|---|---|---|---|
| 3 | N-(4-Bromobutyl)phthalimide | Trimethylamine | CHFSI K |
| 4 | N-(8-Bromooctyl)phthalimide | Trimethylamine | — |
| 5 | N-(8-Bromooctyl)phthalimide | Trimethylamine | TFSI Li |
| 6 | N-(16-Bromohexadecane)phthalimide | Trimethylamine | TFSI Li |
| 7 | N-(4-Bromobutyl)phthalimide | 1-Methylpyrrolidine | TFSI Li |
| 8 | N-(4-Bromobutyl)phthalimide | 1-Methylimidazole | TFSI Li |
| 9 | N-(4-Bromobutyl)phthalimide | 1-Butyl-2-Methylimidazole | TFSI Li |
| 10 | N-(4-Bromobutyl)phthalimide | 3-Butylpyridine | TFSI Li |

Then, the residue was dissolved in 10 ml of ethanol. To the solution, 2.33 g (30 mmol) of an aqueous solution containing 40 wt % of methylamine was added, and then, the mixture was heated to reflux for 72 hours. Then, the solvent was distilled off under reduced pressure. The obtained concentrate was washed with diethyl ether, and the supernatant was removed by decantation. This operation was repeated three times. The anion of the obtained residue was a bromide ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 11 having TFSI as an anion. The structure of the synthesized ionic conductive agent is shown in Table 4.

<Ionic Conductive Agent 12>

The ionic conductive agent was synthesized in the same way as in the ionic conductive agent 10 except that the quaternizing agent was changed to terminally brominated modified polyethylene glycol (molecular weight: approximately 560) and the trimethylamine was changed to N,N-dimethylstearylamine. The structure of the synthesized ionic conductive agent is shown in Table 4.

TABLE 4

| Ionic conductive agent | $R_{801}$ | $R_{802}$ | A | | | | | | | | | Anion |
|---|---|---|---|---|---|---|---|---|---|---|---|---|
| | | | $R_{803}$ | $R_{804}$ | $R_{805}$ | $R_{806}$ | n | B' | $R_{807}$ | $R_{808}$ | $R_{809}$ | |
| 1 | H | $C_2H_4$ | Me | Me | Me | — | — | — | — | — | — | Cl |
| 2 | H | $C_4H_8$ | Me | Me | Me | — | — | — | — | — | — | TFSI |
| 3 | H | $C_4H_8$ | Me | Me | Me | — | — | — | — | — | — | CHFSI |
| 4 | H | $C_8H_{16}$ | Me | Me | Me | — | — | — | — | — | — | Br |
| 5 | H | $C_8H_{16}$ | Me | Me | Me | — | — | — | — | — | — | TFSI |
| 6 | H | $C_{16}H_{32}$ | Me | Me | Me | — | — | — | — | — | — | TFSI |
| 7 | H | $C_4H_8$ | — | — | — | Me | 1 | $CH_2$ | — | — | — | TFSI |
| 8 | H | $C_4H_8$ | — | — | — | — | — | — | Me | H | — | TFSI |
| 9 | H | $C_4H_8$ | — | — | — | — | — | — | $C_4H_9$ | Me | — | TFSI |
| 10 | H | $C_4H_8$ | — | — | — | — | — | — | — | — | n-Bu | TFSI |
| 11 | Me | $C_4H_8$ | n-Bu | n-Bu | n-Bu | — | — | — | — | — | — | TFSI |
| 12 | Me | $(C_2H_4O)_8C_2H_4$ | Me | Me | n-$C_{18}H_{37}$ | — | — | — | — | — | — | TFSI |

TFSI Li: bis(trifluoromethanesulfonyl)imide lithium salt

CHFSI K: cyclohexafluoropropane-1,3-bis(sulfonyl)imide potassium salt

<Ionic Conductive Agent 11>

3.24 g (15 mmol) of a quaternizing agent 1,4-dibromobutane was dissolved in 10 ml of acetonitrile. To the solution, 1.85 g (10 mmol) of tributylamine was added as a tertiary amine at room temperature, and then, the mixture was heated to reflux for 72 hours. Then, the solvent was distilled off under reduced pressure. The obtained concentrate was washed with diethyl ether, and the supernatant was removed by decantation. This operation was repeated three times.

(Synthesis of Ionic Conductive Agent (II))

<Ionic Conductive Agent 13>

1.17 g (10 mmol) of 2,2'-diamino-N-methyldiethylamine and pyridine were dissolved in 10 ml of diethyl ether. To the solution, 3.13 g (20 mmol) of phenyl chloroformate dissolved in 5 ml of diethyl ether was added dropwise, and the mixture was reacted at room temperature. The reaction solution was rendered basic by the addition of an aqueous sodium hydroxide solution, followed by separation. The solvent in the obtained organic layer was distilled off under reduced pressure. The obtained concentrate was dissolved in 10 ml of acetonitrile. Then, to the solution, 1.42 g (10 mmol) of iodomethane was added, and the mixture was stirred at room temperature for 24 hours. Then, the solvent was distilled off under reduced pressure. The obtained concentrate was washed with diethyl ether, and the supernatant was removed by decantation. This operation was repeated three times. Then, the residue was dissolved in 10 ml of ethanol. To the solution, palladium/carbon was added, and the mixture was stirred at room temperature in a hydrogen gas atmosphere. The reaction solution was filtered, and then, the solvent was distilled off under reduced pressure. The anion of the obtained residue was an iodine ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 13 having a bis(trifluoromethanesulfonyl)imide ion (TFSI) as an anion. The structure of the synthesized ionic conductive agent is shown in Table 5.

<Ionic Conductive Agent 14>

1.29 g (10 mmol) of dibutylamine was dissolved as an amine in 10 ml of acetone. Then, to the solution, potassium carbonate was added. Then, 9.00 g (20 mmol) of N-(16-bromohexadecane)phthalimide was added thereto as a quaternizing agent, and the mixture was heated to reflux for 24 hours. The reaction solution was cooled to room temperature and separated by the addition of dichloromethane. The solvent in the obtained organic layer was distilled off under reduced pressure. The obtained concentrate was washed with diethyl ether, and the supernatant was removed by decantation. This operation was repeated three times. Then, the residue was dissolved in 10 ml of ethanol. To the solution, 0.95 g (15 mmol) of hydrazine monohydrate (79%) was added, and the mixture was heated with stirring at 40° C. for 4 hours, cooled to room temperature, and then filtered. The solvent in the filtrate was distilled off under reduced pressure. The anion of the obtained residue was a bromide ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 14 having a bis(trifluoromethanesulfonyl)imide ion (TFSI) as an anion. The structure of the synthesized ionic conductive agent is shown in Table 5.

<Ionic Conductive Agent 15>

Ionic conductive agent 15 was obtained by synthesis in the same way as in the ionic conductive agent 14 except that the amine was changed to morpholine and the quaternizing agent was changed to N-(4-bromobutyl)phthalimide. The structure of the synthesized ionic conductive agent is shown in Table 5.

TABLE 5

| Ionic conductive agent | $R_{901}$ | $R_{902}$ | $R_{903}$ | $R_{904}$ | C' $R_{905}$ | C' $R_{906}$ | C' n | C' D | Anion |
|---|---|---|---|---|---|---|---|---|---|
| 13 | H | H | $C_2H_4$ | $C_2H_4$ | Me | Me | — | — | TFSI |
| 14 | H | H | $C_{16}H_{32}$ | $C_{16}H_{32}$ | Bu | Bu | — | — | TFSI |
| 15 | H | H | $C_4H_8$ | $C_4H_8$ | — | — | 2 | O | TFSI |

(Synthesis of Ionic Conductive Agent (III))

<Ionic Conductive Agent 16>

The ionic conductive agent was synthesized in the same way as in the ionic conductive agent 13 except that the 2,2'-diamino-N-methyldiethylamine was changed to tris(3-aminopropyl)amine and 4.70 g (30 mmol) of phenyl chloroformate was used. The structure of the synthesized ionic conductive agent is shown in Table 6.

<Ionic Conductive Agent 17>

5.55 g (30 mmol) of potassium phthalimide was dissolved in 20 ml of dimethylformamide. Then, to the solution, 5.61 g (30 mmol) of 1,2-bis(2-chloroethoxy)ethane was added, and the mixture was heated to reflux. The solution was cooled to room temperature and separated by the addition of ion-exchange water and ethyl acetate. The solvent in the obtained organic layer was distilled off under reduced pressure to obtain a quaternizing agent. This quaternizing agent was dissolved in 20 ml of acetone. Then, to the solution, 0.73 g (10 mmol) of n-butylamine and potassium carbonate were added, and the mixture was heated to reflux for 24 hours. The obtained reaction solution was filtered, and the solvent in the filtrate was distilled off under reduced pressure. The obtained concentrate was washed with diethyl ether, and the supernatant was removed by decantation. This operation was repeated three times. The anion of the obtained residue was a chloride ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 17 having a bis(trifluoromethanesulfonyl)imide ion (TFSI) as an anion. The structure of the synthesized ionic conductive agent is shown in Table 6.

TABLE 6

| Ionic conductive agent | $R_{1001}$ | $R_{1002}$ | $R_{1003}$ | $R_{1004}$ | $R_{1005}$ | $R_{1006}$ | $R_{1007}$ | Anion |
|---|---|---|---|---|---|---|---|---|
| 16 | H | H | H | $C_3H_6$ | $C_3H_6$ | $C_3H_6$ | $CH_3$ | TFSI |
| 17 | H | H | H | $(C_2H_4O)_2C_2H_4$ | $(C_2H_4O)_2C_2H_4$ | $(C_2H_4O)_2C_2H_4$ | Bu | TFSI |

(Synthesis of Ionic Conductive Agent (IV))

<Ionic Conductive Agent 18>

1.46 g (10 mmol) of tris(3-aminoethyl)amine and pyridine were dissolved in 20 ml of diethyl ether. To the solution, 4.70 g (30 mmol) of phenyl chloroformate was added dropwise, and the mixture was reacted at room temperature. The reaction solution was rendered basic by the addition of an aqueous sodium hydroxide solution, followed by separation. The solvent in the obtained organic layer was distilled off under reduced pressure. The obtained concentrate and 7.88 g (10 mmol) of N-(12-bromododecane)phthalimide were dissolved in 20 ml of acetone, and the solution was heated to reflux for 24 hours. Then, the solvent was distilled off under reduced pressure. The obtained concentrate was washed with diethyl ether, and the supernatant was removed by decantation. This operation was repeated three times. Then, the residue was dissolved in 10 ml of ethanol. To the solution, 0.95 g (15 mmol) of hydrazine monohydrate (79%) was added, and the mixture was heated with stirring at 40° C. for 4 hours, cooled to room temperature, and then filtered. The organic solvent in the obtained filtrate was distilled off under reduced pressure. The obtained residue was dissolved in 10 ml of ethanol. To the solution, palladium/carbon was added, and the mixture was stirred at room temperature in a hydrogen gas atmosphere. The reaction solution was filtered, and then, the solvent was distilled off under reduced pressure. The anion of the obtained residue was a bromine ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 18 having a bis(trifluoromethanesulfonyl)imide ion (TFSI) as an anion. The structure of the synthesized ionic conductive agent is shown in Table 7.

TABLE 7

| Ionic conductive agent | $R_{1101}$ | $R_{1102}$ | $R_{1103}$ | $R_{1104}$ | $R_{1105}$ | $R_{1106}$ | $R_{1107}$ | $R_{1108}$ | Anion |
|---|---|---|---|---|---|---|---|---|---|
| 18 | H | H | H | H | $C_2H_4$ | $C_2H_4$ | $C_2H_4$ | $C_{12}H_{24}$ | TFSI |
| 19 | H | H | H | H | $(C_2H_4O)_2C_2H_4$ | $(C_2H_4O)_2C_2H_4$ | $(C_2H_4O)_2C_2H_4$ | $(C_2H_4O)_2C_2H_4$ | TFSI |

<Ionic Conductive Agent 19>

1.48 g (10 mmol) of 1,2-bis(2-aminoethoxy)ethane and pyridine were dissolved in 10 ml of diethyl ether. To the solution, 1.57 g (10 mmol) of phenyl chloroformate was added dropwise, and the mixture was reacted at room temperature. The reaction solution was rendered basic by the addition of an aqueous sodium hydroxide solution, followed by separation. The solvent in the obtained organic layer was distilled off under reduced pressure to obtain a raw material amine.

5.55 g (30 mmol) of potassium phthalimide was dissolved in 30 ml of dimethylformamide. Then, to the solution, 5.61 g (30 mmol) of 1,2-bis(2-chloroethoxy)ethane was added, and the mixture was heated to reflux. The solution was cooled to room temperature and separated by the addition of ion-exchange water and ethyl acetate. The solvent in the obtained organic layer was distilled off under reduced pressure to obtain a quaternizing agent.

2.68 g (10 mmol) of the raw material amine and 8.93 g (30 mmol) of the quaternizing agent were dissolved in 50 ml of acetone. To the solution, potassium carbonate was added, and the mixture was heated to reflux for 24 hours. Then, the reaction solution was filtered, and the organic solvent was distilled off from the filtrate under reduced pressure. The obtained concentrate was washed with diethyl ether, and the supernatant was removed by decantation. This operation was repeated three times. Then, the residue was dissolved in 30 ml of ethanol. To the solution, 2.85 g (45 mmol) of hydrazine monohydrate (79%) was added, and the mixture was heated with stirring at 40° C. for 4 hours, cooled to room temperature, and then filtered. The organic solvent in the obtained filtrate was distilled off under reduced pressure. The obtained residue was dissolved in 10 ml of ethanol. To the solution, palladium/carbon was added, and the mixture was stirred at room temperature in a hydrogen gas atmosphere. The reaction solution was filtered, and then, the solvent was distilled off under reduced pressure. The anion of the obtained residue was a chloride ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 19 having a bis(trifluoromethanesulfonyl)imide ion (TFSI) as an anion. The structure of the synthesized ionic conductive agent is shown in Table 7.

(Synthesis of Ionic Conductive Agent (V))

<Ionic Conductive Agent 20>

2.54 g (10 mmol) of N-(2-bromoethyl)phthalimide was dissolved as a quaternizing agent in 20 ml of ethanol. To the solution, 1.85 g (10 mmol) of tributylamine was added as a tertiary amine, and the mixture was heated to reflux for 24 hours. Then, the solvent was distilled off under reduced pressure. The obtained concentrate was washed with diethyl ether, and the supernatant was removed by decantation. This operation was repeated three times. Then, the residue was dissolved in 10 ml of ethanol. To the solution, 0.95 g (15 mmol) of hydrazine monohydrate (79%) was added, and the mixture was heated with stirring at 40° C. for 4 hours, then cooled to room temperature, and filtered. The solvent in the filtrate was distilled off under reduced pressure to obtain a residue. This residue and 5.08 g (20 mmol) of a tertiarizing agent N-(2-bromoethyl)phthalimide were dissolved in 30 ml of acetone. To the solution, potassium carbonate was added, and then, the mixture was heated to reflux for 72 hours. Then, the solvent was distilled off under reduced pressure. The obtained concentrate was washed with diethyl ether, and the supernatant was removed by decantation. This operation was repeated three times. Then, the residue was dissolved in 30 ml of ethanol. To the solution, 1.90 g (30 mmol) of hydrazine monohydrate (79%) was added, and the mixture was heated with stirring at 40° C. for 4 hours, then cooled to room temperature, and filtered. The solvent in the filtrate was distilled off under reduced pressure to obtain a residue. The anion of the obtained residue was a bromide ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 20 having a bis(trifluoromethanesulfonyl)imide ion (TFSI) as an anion. The structure of the synthesized ionic conductive agent is shown in Table 9.

<Ionic Conductive Agents 21 to 31>

The ionic conductive agents were synthesized in the same way as in the ionic conductive agent 20 except that the quaternizing agent, the tertiary amine and the anion-exchange salt were changed to those described in Table 8. The structure of each synthesized ionic conductive agent is shown in Table 9.

TABLE 8

| Ionic Conductive agent | Quaternizing agent | Tertiary amine | Tertiarizing agent | Anion-exchange salt |
|---|---|---|---|---|
| 21 | N-(4-Bromobutyl) phthalimide | Trimethylamine | N-(4-Bromobutyl) phthalimide | TFSI Li |
| 22 | N-(4-Bromobutyl) phthalimide | Trimethylamine | N-(4-Bromobutyl) phthalimide | CHFSI K |
| 23 | N-(8-Bromooctyl) phthalimide | N,N-Dimethylstearylamine | N-(8-Bromooctyl) phthalimide | TFSI Li |
| 24 | N-(16-Bromohexadecane) phthalimide | Trimethylamine | N-(4-Bromobutyl) phthalimide | TFSI Li |
| 25 | N-(16-Bromohexadecane) phthalimide | Trimethylamine | N-(16-Bromohexadecane) phthalimide | TFSI Li |
| 26 | N-(8-Chloro-3,6-dioxaneoctane) phthalimide | Trimethylamine | N-(8-Chloro-3,6-dioxaneoctane) phthalimide | TFSI Li |
| 27 | N-(8-Bromooctyl) phthalimide | 4-Ethylmorpholine | N-(8-Bromooctyl) phthalimide | TFSI Li |
| 28 | N-(4-Bromobutyl) phthalimide | 1-Methylimidazole | N-(4-Bromobutyl) phthalimide | TFSI Li |
| 29 | N-(12-bromododecane) phthalimide | 1-Ethylimidazole | N-(12-bromododecane) phthalimide | TFSI Li |
| 30 | N-(4-Bromobutyl) phthalimide | 1-Butyl-2-methylimidazole | N-(4-Bromobutyl) phthalimide | TFSI Li |
| 31 | N-(4-Bromobutyl) phthalimide | 3-Butylpyridine | N-(4-Bromobutyl) phthalimide | TFSI Li |

CHFSI K: cyclohexafluoropropane-1,3-bis(sulfonyl)imide potassium salt

TABLE 9

| Ionic conductive agent | $R_{1201}$ | $R_{1202}$ | $R_{1203}$ | $R_{1204}$ | $R_{1205}$ | G | F' $R_{1206}$ | $R_{1207}$ | $R_{1208}$ | $R_{1209}$ | n | H' | $R_{1210}$ | $R_{1211}$ | $R_{1212}$ | Anion |
|---|---|---|---|---|---|---|---|---|---|---|---|---|---|---|---|---|
| 20 | H | H | $C_2H_4$ | $C_2H_4$ | $C_2H_4$ | N | Bu | Bu | Bu | — | — | — | — | — | — | TFSI |
| 21 | H | H | $C_4H_8$ | $C_4H_8$ | $C_4H_8$ | N | Me | Me | Me | — | — | — | — | — | — | TFSI |
| 22 | H | H | $C_4H_8$ | $C_4H_8$ | $C_4H_8$ | N | Me | Me | Me | — | — | — | — | — | — | CHFSI |
| 23 | H | H | $C_8H_{16}$ | $C_8H_{16}$ | $C_8H_{16}$ | N | Me | Me | n-$C_{18}H_{37}$ | | | | | | | TFSI |
| 24 | H | H | $C_4H_8$ | $C_4H_8$ | $C_{16}H_{32}$ | N | Me | Me | Me | — | — | — | — | — | — | TFSI |
| 25 | H | H | $C_{16}H_{32}$ | $C_{16}H_{32}$ | $C_{16}H_{32}$ | N | Me | Me | Me | — | — | — | — | — | — | TFSI |
| 26 | H | H | $(C_2H_4O)_2C_2H_4$ | $(C_2H_4O)_2C_2H_4$ | $(C_2H_4O)_2C_2H_4$ | N | Me | Me | Me | — | — | — | — | — | — | TFSI |
| 27 | H | H | $C_8H_{16}$ | $C_8H_{16}$ | $C_8H_{16}$ | N | — | — | — | Et | 2 | O | — | — | — | TFSI |
| 28 | H | H | $C_4H_8$ | $C_4H_8$ | $C_4H_8$ | N | — | — | — | — | — | — | Me | H | — | TFSI |
| 29 | H | H | $C_{12}H_{24}$ | $C_{12}H_{24}$ | $C_{12}H_{24}$ | N | — | — | — | — | — | — | Et | H | — | TFSI |
| 30 | H | H | $C_4H_8$ | $C_4H_8$ | $C_4H_8$ | N | — | — | — | — | — | — | $C_4H_9$ | Me | — | TFSI |
| 31 | H | H | $C_4H_8$ | $C_4H_8$ | $C_4H_8$ | N | — | — | — | — | — | — | — | — | 3-Bu | TFSI |

(Synthesis of Ionic Conductive Agent (VI))

<Ionic Conductive Agent 32>

1.46 g (10 mmol) of tris(3-aminoethyl)amine and pyridine were dissolved in 20 ml of diethyl ether. To the solution, 4.70 g (30 mmol) of phenyl chloroformate was added dropwise, and the mixture was reacted at room temperature. The reaction solution was rendered basic by the addition of an aqueous sodium hydroxide solution, followed by separation. The solvent in the obtained organic layer was distilled off under reduced pressure. The obtained residue and 1.59 g (10 mmol) of chlorocholine chloride were dissolved in 20 ml of ethanol, and the mixture was heated to reflux for 24 hours. Then, the solvent was distilled off under reduced pressure. The obtained concentrate was washed with diethyl ether, and the supernatant was removed by decantation. This operation was repeated three times. Then, the obtained residue was dissolved in 10 ml of ethanol. To the solution, palladium/carbon was added, and the mixture was stirred at room temperature in a hydrogen gas atmosphere. The reaction solution was filtered, and then, the solvent was distilled off under reduced pressure. The anion of the obtained residue was a chloride ion.

For anion exchange, the obtained residue was dissolved in 5 ml of dichloromethane. Then, to the solution, an aqueous solution containing 2.87 g (10 mmol) of lithium bis(trifluoromethanesulfonyl)imide dissolved therein was added as an anion-exchange salt, and the mixture was stirred for 24 hours. The obtained solution was separated to obtain an organic layer. This organic layer was washed twice with water and separated, and then, the dichloromethane was distilled off under reduced pressure to obtain ionic conductive agent 32 having a bis(trifluoromethanesulfonyl)imide ion (TFSI) as an anion. The structure of the synthesized ionic conductive agent is shown in Table 11.

<Ionic Conductive Agents 33 to 38>

The ionic conductive agents were synthesized in the same way as in the ionic conductive agent 20 except that the quaternizing agent, the tertiary amine, the tertiarizing agent (the amount added was changed to 30 mmol) and the anion-exchange salt (the amount added was changed to 20 mmol) were changed to those described in Table 10. The structure of each synthesized ionic conductive agent is shown in Table 11.

TABLE 10

| Ionic conductive agent | Quaternizing agent | Tertiary amine | Tertiarizing agent | Anion-exchange salt |
|---|---|---|---|---|
| 33 | N-(8-Bromooctyl)phthalimide | Trihexylamine | N-(8-Bromooctyl)phthalimide | TFSI Li |
| 34 | N-(8-Chloro-3,6-dioxaneoctane)phthalimide | Tributylamine | N-(8-Chloro-3,6-dioxaneoctane)phthalimide | TFSI Li |
| 35 | N-(2-Bromoethyl)phthalimide | 1-Methylpyrrolidine | N-(2-Bromoethyl)phthalimide | TFSI Li |
| 36 | N-(2-Bromoethyl)phthalimide | 1-Methylimidazole | N-(2-Bromoethyl)phthalimide | TFSI Li |
| 37 | N-(16-Bromohexadecane) phthalimide | 1-Butyl,2-methylimidazole | N-(16-Bromohexadecane)phthalimide | TFSI Li |
| 38 | N-(4-Bromobutyl)phthalimide | Pyridine | N-(4-Bromobutyl)phthalimide | TFSI Li |

TABLE 11

| Ionic conductive agent | $R_{1301}$ | $R_{1302}$ | $R_{1303}$ | $R_{1304}$ | $R_{1305}$ | $R_{1306}$ | $R_{1307}$ |
|---|---|---|---|---|---|---|---|
| 32 | H | H | H | $C_2H_4$ | $C_2H_4$ | $C_2H_4$ | $C_2H_4$ |
| 33 | H | H | H | $C_8H_{16}$ | $C_8H_{16}$ | $C_8H_{16}$ | $C_8H_{16}$ |
| 34 | H | H | H | $(C_2H_4O)_2C_2H_4$ | $(C_2H_4O)_2C_2H_4$ | $(C_2H_4O)_2C_2H_4$ | $(C_2H_4O)_2C_2H_4$ |
| 35 | H | H | H | $C_2H_4$ | $C_2H_4$ | $C_2H_4$ | $C_2H_4$ |
| 36 | H | H | H | $C_2H_4$ | $C_2H_4$ | $C_2H_4$ | $C_2H_4$ |
| 37 | H | H | H | $C_{16}H_{32}$ | $C_{16}H_{32}$ | $C_{16}H_{32}$ | $C_{12}H_{24}$ |
| 38 | H | H | H | $C_4H_8$ | $C_4H_8$ | $C_4H_8$ | $C_4H_8$ |

| Ionic conductive agent | I' | J | | | | | | | | |
|---|---|---|---|---|---|---|---|---|---|---|
| | | $R_{1308}$ | $R_{1309}$ | $R_{1310}$ | $R_{1311}$ | n | K' | $R_{1312}$ | $R_{1313}$ | $R_{1314}$ |
| 32 | $N^+$ | Me | Me | Me | — | — | — | — | — | — |
| 33 | $N^+$ | Hex | Hex | Hex | — | — | — | — | — | — |
| 34 | $N^+$ | Bu | Bu | Bu | — | — | — | — | — | — |
| 35 | $N^+$ | — | — | — | Me | 1 | $CH_2$ | — | — | — |
| 36 | $N^+$ | — | — | — | — | — | — | Me | H | — |
| 37 | $N^+$ | — | — | — | — | — | — | $C_4H_9$ | Me | — |
| 38 | $N^+$ | — | — | — | — | — | — | — | — | H |

(Synthesis of Ionic Conductive Agent (VII))

<Ionic Conductive Agent 39>

4.12 g (10 mmol) of the ionic conductive agent 13 was dissolved as an amine in 30 ml of ethanol. To the solution, 10.16 g (40 mmol) of N-(2-bromoethyl)phthalimide as a halide and potassium carbonate were added, and the mixture was heated to reflux for 24 hours. After filtration, 2.53 g (40 mmol) of hydrazine monohydrate (79%) was added to the filtrate, and the mixture was heated with stirring at 40° C. for 4 hours, then cooled to room temperature, and filtered. The solvent in the filtrate was distilled off under reduced pressure. The obtained concentrate was washed with diethyl ether, and the supernatant was removed by decantation. This operation was repeated three times, followed by drying under reduced pressure. The anion of the obtained residue was a TFSI ion. The structure of the synthesized ionic conductive agent is shown in Table 13.

<Ionic Conductive Agents 40 and 41>

The ionic conductive agents were synthesized in the same way as in the ionic conductive agent 38 except that the amine and the halide were changed to those described in Table 12.

TABLE 12

| Ionic conductive agent | Halide | Amine |
|---|---|---|
| 40 | N-(16-Bromohexadecane)phthalimide | Ionic conductive agent 14 |
| 41 | N-(4-Bromobutyl)phthalimide | Ionic conductive agent 15 |

TABLE 13

| Ionic conductive agent | $R_{1401}$ | $R_{1402}$ | $R_{1403}$ | $R_{1404}$ | $R_{1405}$ | $R_{1406}$ | $R_{1407}$ | $R_{1408}$ | $R_{1409}$ | $R_{1410}$ | L, L' | M $R_{1411}$ | M $R_{1412}$ | n | P' | Anion |
|---|---|---|---|---|---|---|---|---|---|---|---|---|---|---|---|---|
| 39 | H | H | H | H | $C_2H_4$ | $C_2H_4$ | $C_2H_4$ | $C_2H_4$ | $C_2H_4$ | $C_2H_4$ | N | Me | Me | — | — | TFSI |
| 40 | H | H | H | H | $C_{16}H_{32}$ | $C_{16}H_{32}$ | $C_{16}H_{32}$ | $C_{16}H_{32}$ | $C_{16}H_{32}$ | $C_{16}H_{32}$ | N | Bu | Bu | — | — | TFSI |
| 41 | H | H | H | H | $C_2H_4$ | $C_2H_4$ | $C_2H_4$ | $C_2H_4$ | $C_2H_4$ | $C_2H_4$ | N | — | — | 2 | O | TFSI |

<4. Preparation of Surface Layer (Electro-Conductive Layer)>

(Synthesis of Isocyanate Group-Terminated Prepolymer 1)

In a nitrogen atmosphere, 100 parts by mass of polypropylene glycol having a molecular weight of 3000 in which propylene oxide was added to glycerin (trade name: Excenol 2040 manufactured by Asahi Glass Co., Ltd.) were gradually added to 27 parts by mass of polymeric MDI (trade name: Millionate MR200 manufactured by Nippon Polyurethane Industry Co., Ltd.) in a reaction vessel, while the internal temperature of the reaction vessel was kept at 65° C. After the completion of the dropwise addition, the mixture was reacted at a temperature of 65° C. for 2 hours. The obtained reaction mixture was cooled to room temperature to obtain isocyanate group-terminated prepolymer 1 having an isocyanate group content of 3.31%.

(Preparation of Coating Solution 1)

60.4 parts by mass of the isocyanate group-terminated prepolymer 1 were mixed by stirring with 39.6 parts by mass of polyether diol in which ethylene oxide was addition-polymerized with polypropylene glycol having a molecular weight of 3000 (trade name: Adeka Polyether PR-3007) and 2 parts by mass of the ionic conductive agent 1.

Next, methyl ethyl ketone (hereinafter, referred to as MEK) was added thereto at a total solid ratio of 30% by mass, followed by mixing with a sand mill. Subsequently, the viscosity of the mixture was further adjusted to 12 cps using MEK to prepare coating solution 1.

Example 1

The electro-conductive roller prepared beforehand was dipped in the coating solution 1 to form a coating film of the coating solution on the surface of the elastic layer in the electro-conductive roller. This film was dried and further heat-treated for 1 hour in an oven heated to a temperature of 140° C. so that a surface layer of approximately 15 μm was disposed on the outer circumference of the elastic layer to prepare the electrophotographic member according to Example 1. By IR, NMR and TOF-SIMS, the surface layer was confirmed to contain the partial structure according to the present invention.

<Electrical Resistivity Measurement of Electro-Conductive Layer>

The electrical resistivity (film resistance) of the electro-conductive layer was calculated by alternating-current impedance measurement according to the four-terminal method. The measurement was conducted at a voltage magnitude of 5 mV and a frequency of 1 Hz to 1 MHz. When the prepared electro-conductive roller had a plurality of electro-conductive layers, an electro-conductive layer (electro-conductive layer other than a resin layer) placed more externally than the resin layer that satisfied the requirements of the present invention was peeled off, and the electrical resistivity of the electro-conductive layer that satisfied the requirements of the present invention was measured. The electrical resistivity was measured 5 times, and an average of the 5 measurement values was used as the electrical resistivity of the present invention. The electrical resistivity measurement was conducted in an environment having a temperature of 25° C. and a humidity of 50% R.H. (hereinafter, also referred to as N/N). In this Example, the electrophotographic member was left for 48 hours or longer in the N/N environment before the evaluation. The evaluation results are shown in Table 14-1.

<Bleeding Test>

The bleeding test was conducted as described below.

The bleeding test was conducted using a process cartridge for an electrophotographic laser printer (trade name: HP Color Laserjet Enterprise CP4515dn manufactured by Hewlett-Packard Development Company, L.P.). The process cartridge was disintegrated, and the prepared electrophotographic member was incorporated therein as a charging roller and left for 1 month in contact with a photosensitive member in an environment having a temperature of 40° C. and a humidity of 95% R.H. Then, the surface of the photosensitive member was observed under an optical microscope (×10) to observe the presence or absence of the attachment of bled matter from the electro-conductive roller and the presence or absence of cracks on the surface of the photosensitive member. Evaluation was conducted according to the criteria given below. The evaluation results are shown in Table 14-1.

A: No attachment of bled matter was observed on the surface of the contact site of the photosensitive member.

B: The slight attachment of bled matter was found in a portion of the contact site.

C: The slight attachment of bled matter was found on the entire surface of the contact site.

D: Bled matter and cracks were found in the contact site.

<Evaluation of Roller Resistance Value Variation>

Figure 4A:
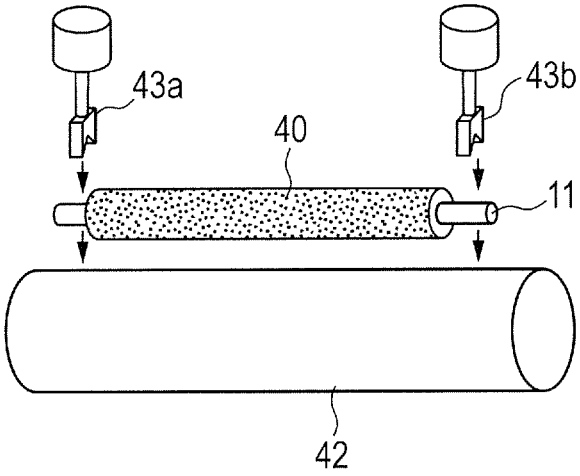
FIGS. 4A and 4B are illustrations of the evaluation jig for roller resistance value variation according to the present invention.
Figure 4B:
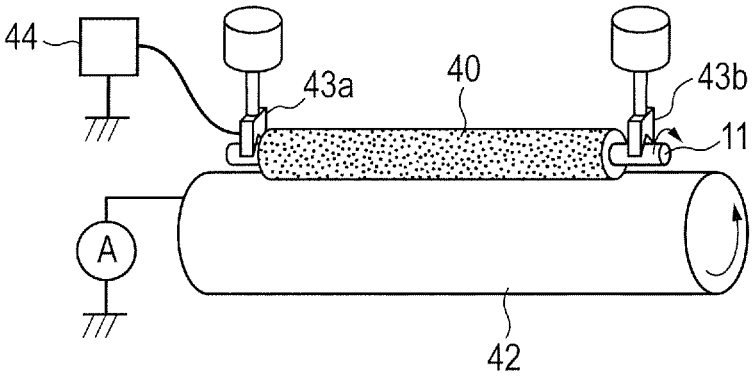

FIGS. 4A and 4B are schematic configuration diagrams illustrating the evaluation jig for roller resistance value variation according to the present invention. As illustrated in FIGS. 4A and 4B, a cylindrical metal 42 of 24 mm in diameter was contacted with a load of 500 gf on each side and electrified to carry out degradation caused by electrification. In FIG. 4A, 43*a* and 43*b* depict bearings fixed to the weight and apply stress in the vertical downward direction to both ends of the electro-conductive mandrel 11 in the electro-conductive roller 40. In the vertical downward direction of the electro-conductive roller 40, the cylindrical metal 42 was positioned in parallel with the electro-conductive roller 40. The cylindrical metal 42 was rotated at the same rotational speed as that of the photosensitive member in a usage state by a drive apparatus (not shown), while the electro-conductive roller 40 was pressed against the bearings 43*a* and 43*b* as illustrated in FIG. 4B. Then, a direct current of 450 μA was applied thereto by a power source 44 at the same time with the rotation of the cylindrical metal 42 at 30 rpm. Two seconds after the current application, time-average voltage applied from a power source 24 was started to be measured using voltmeter A. The initial roller resistance of the electro-conductive roller was calculated from time-dependent voltage resulting from 5-second measurement. After the initial roller resistance value measurement, a current of 450 μA was continuously applied thereto for 10 minutes. Then, time-average voltage applied from a power source 53 was started to be measured using the voltmeter A. The roller resistance of the electro-conductive roller after the electrification was calculated from time-dependent voltage resulting from 5-second measurement. Then, the roller resistance value determined 10 minutes after the current application was divided by the initial roller resistance value (Roller resistance value after 10 minutes/Initial roller resistance value) to evaluate change in electro-conductivity caused by electrification. The evaluation results are shown in Table 14-1.

<Evaluation of Continuous Image Output Durability>

Change in electro-conductivity (elevation of electrical resistance) caused by electrification of a charging roller may cause uneven density having fine streaks (horizontal streaks) on halftone images. Such images are referred to as images with horizontal streaks. These images with horizontal streaks tend to be deteriorated with change in electro-conductivity and tend to become conspicuous in long-term use. The electrophotographic member of the present invention was incorporated as a charging roller and evaluated as follows.

An electrophotographic laser printer (trade name: HP Color Laserjet Enterprise CP4515dn manufactured by Hewlett-Packard Development Company, L.P.) was equipped with the electro-conductive roller obtained as described above as a charging roller. Then, images having a printing density of 4% (images in which horizontal lines having a width of 2 dots and an interval of 50 dots were drawn in the rotational direction and vertical direction of the photosensitive member) were continuously output in a durability test. After output of 24000 images, halftone images (images in which horizontal lines having a width of dot and an interval of 2 dots were drawn in the rotational direction and vertical direction of the photosensitive member) were output for image check. The obtained images were visually observed to evaluate uneven density having fine streaks (horizontal streaks). The evaluation results are shown in Table 14-1.

A: No horizontal streak was generated.

B: Horizontal streaks were slightly generated only at the ends of the image.

C: Horizontal streaks were slightly generated at the ends and central portion of the image, but were free from practical problem.

D: Horizontal streaks were generated in almost half of the region of the image and were conspicuous.

Examples 2 to 12

The electrophotographic members were produced in the same way as in Example 1 except that the type of the ionic conductive agent added to the coating solution 1 was changed as shown in Table 14-1. These electrophotographic members were evaluated in the same way as in Example 1. The evaluation results are shown in Table 14-1.

Example 13

(Synthesis of Polyol)

80.4 wt % of α-caprolactone, 19.6 wt % of trimethylolpropane, and titanium tetra-n-butoxide as a catalyst were added to a glass flask with a stirrer and reacted at a temperature of 180° C. for 6 hours in a nitrogen atmosphere to obtain polyester polyol. Its hydroxy value was 74.0 mg KOH/g. This polyester polyol was mixed with polyfunctional isocyanate (trade name: Duranate 24A100; manufactured by Asahi Kasei Chemicals Corp.) and bifunctional isocyanate (trade name: Duranate D101; manufactured by Asahi Kasei Chemicals Corp.) (mixing ratio: 24A100:D101=0.38:0.62) at an OH:NCO ratio of 2:1. The mixture was vigorously stirred at a temperature of 100° C. for 6 hours to obtain a hydroxy group-terminated prepolymer having a hydroxy value of 34.0 mg KOH/g.

(Synthesis of Isocyanate Group-Terminated Prepolymer 2)

The polyester polyol was mixed with polyfunctional isocyanate (trade name: Duranate 24A100; manufactured by Asahi Kasei Chemicals Corp.) and bifunctional isocyanate (trade name: Duranate D101; manufactured by Asahi Kasei Chemicals Corp.) (mixing ratio: 24A100:D101=0.38:0.62) at an OH:NCO ratio of 1:2. The mixture was vigorously stirred at 100° C. for 6 hours to obtain an isocyanate group-terminated prepolymer 2 having an isocyanate group content of 4.5% by weight.

(Preparation of Coating Solution 2)

40.4 parts by mass of the isocyanate group-terminated prepolymer 2 were mixed by stirring with 59.6 parts by mass of the hydroxy group-terminated prepolymer and 2.0 parts by mass of the ionic conductive agent 2. Next, methyl ethyl ketone (hereinafter, referred to as MEK) was added thereto at a total solid ratio of 30% by mass, followed by mixing with a sand mill. Subsequently, the viscosity of the mixture was further adjusted to 10 to 13 cps using MEK to prepare coating solution 2 for surface layer formation.

The electro-conductive roller prepared beforehand was dipped in the coating solution 2 to form a coating film of the coating solution on the surface of the elastic layer in the electro-conductive roller. This film was dried and further heat-treated for 1 hour in an oven heated to a temperature of 140° C. so that a surface layer of approximately 15 μm was disposed on the outer circumference of the elastic layer to prepare the electrophotographic member according to Example 13, which was evaluated in the same way as in Example 1. The evaluation results are shown in Table 14-1.

Example 14

(Preparation of Coating Solution 3)

51.8 parts by mass of polyethylene glycol diglycidyl ether (trade name: "Denacol EX-841"; manufactured by Nagase ChemteX Corp.), 37.1 parts by mass of polypropylene glycol diglycidyl ether (trade name, "Denacol EX-931"; manufactured by Nagase ChemteX Corp.), 11.1 parts by mass of ethylene glycol bis(aminoethyl) ether (manufactured by Sigma-Aldrich Corp.) and 2 parts by mass of the ionic conductive agent 2 were mixed by stirring.

Next, isopropyl alcohol (hereinafter, referred to as IPA) was added thereto at a total solid ratio of 30% by mass, followed by mixing with a sand mill. Subsequently, the viscosity of the mixture was further adjusted to 12 cps using IPA to prepare coating solution 3.

The electro-conductive roller prepared beforehand was dipped in the coating solution 3 to form a coating film of the coating solution on the surface of the elastic layer in the electro-conductive roller. This film was dried and further heat-treated for 1 hour in an oven heated to a temperature of 140° C. so that a surface layer of approximately 15 μm was disposed on the outer circumference of the elastic layer to prepare the electrophotographic member according to Example 14, which was evaluated in the same way as in Example 1. The evaluation results are shown in Table 14-1.

Example 15

(Preparation of Coating Solution 4)

1.83 g (10 mmol) of adipoyl chloride was added to 20 ml of ethyl acetate. The temperature of the reaction system was set to 0° C. 2.02 g (20 mmol) of triethylamine was added dropwise thereto, and then, 3.39 g (10 mmol) of the ionic conductive agent 2 and 0.90 g (10 mmol) of 1,4-butanediol were added dropwise thereto. The reaction system was rendered basic by the addition of an aqueous sodium hydroxide solution and then separated by the addition of ethyl acetate. The organic solvent was distilled off from the obtained organic layer under reduced pressure to obtain a concentrate. 2 parts by mass of this concentrate and 60.4 parts by mass of the isocyanate group-terminated prepolymer 1 were mixed by stirring with 39.6 parts by mass of polyether diol in which ethylene oxide was addition-polymerized with polypropylene glycol having a molecular weight of 3000 (trade name: Adeka Polyether PR-3007).

Next, methyl ethyl ketone (hereinafter, referred to as MEK) was added thereto at a total solid ratio of 30% by mass, followed by mixing with a sand mill. Subsequently, the viscosity of the mixture was further adjusted to 12 cps using MEK to prepare coating solution 4.

The electrophotographic member was prepared in the same way as in Example 1 except that the coating solution was changed to the coating solution 4. The electrophotographic member was evaluated in the same way as in Example 1. The evaluation results are shown in Table 14-1.

Example 16

(Synthesis of Isocyanate Group-Terminated Prepolymer 3)

In a nitrogen atmosphere, 100 parts by mass of polytetramethylene glycol having a molecular weight of 1000 (trade name: PTMG1000 manufactured by Mitsubishi Chemical Corp) were gradually added to 27 parts by mass of polymeric MDI (trade name: Millionate MR200 manufactured by Nippon Polyurethane Industry Co., Ltd.) in a reaction vessel, while the internal temperature of the reaction vessel was kept at 65° C. After the completion of the dropwise addition, the mixture was reacted at a temperature of 65° C. for 2 hours. The obtained reaction mixture was cooled to room temperature to obtain isocyanate group-terminated prepolymer 3 having an isocyanate group content of 3.31%.

(Preparation of Coating Solution 5)

60.4 parts by mass of the isocyanate group-terminated prepolymer 3 were mixed by stirring with 39.6 parts by mass of polyether diol in which ethylene oxide was addition-polymerized with polypropylene glycol having a molecular weight of 3000 (trade name: Adeka Polyether PR-3007) and 2 parts by mass of the ionic conductive agent 2.

Next, methyl ethyl ketone (hereinafter, referred to as MEK) was added thereto at a total solid ratio of 30% by mass, followed by mixing with a sand mill. Subsequently, the viscosity of the mixture was further adjusted to 12 cps using MEK to prepare coating solution 5.

The electrophotographic member was prepared in the same way as in Example 1 except that the coating solution was changed to the coating solution 5. The electrophotographic member was evaluated in the same way as in Example 1. The evaluation results are shown in Table 14-1.

Example 17

(Preparation of Coating Solution 6)

60.4 parts by mass of the isocyanate group-terminated prepolymer 3 were mixed by stirring with 39.6 parts by mass of polypropylene glycol having a molecular weight of 3000 (trade name: Excenol 240 manufactured by Asahi Glass Co., Ltd.) and 2 parts by mass of the ionic conductive agent 2.

Next, methyl ethyl ketone (hereinafter, referred to as MEK) was added thereto at a total solid ratio of 30% by mass, followed by mixing with a sand mill. Subsequently, the viscosity of the mixture was further adjusted to 12 cps using MEK to prepare coating solution 6.

The electrophotographic member was prepared in the same way as in Example 1 except that the coating solution was changed to the coating solution 6. The electrophotographic member was evaluated in the same way as in Example 1. The evaluation results are shown in Table 14-1.

Example 18-19

The electrophotographic member was produced in the same way as in Example 1 except that the type and the amount of the ionic conductive agent added to the coating solution 1 were changed as shown in Table 14. The electrophotographic member was evaluated in the same way as in Example 1. The evaluation results are shown in Table 14-1.

Example 20

The electrophotographic member was produced in the same way as in Example 2 except that an electro-conductive roller produced from an unvulcanized rubber composition obtained by mixing materials described in Table 15 below using an open roll. The electrophotographic member was evaluated in the same way as in Example 2. The evaluation results are shown in Table 14-1.

TABLE 15

| | |
|---|---|
| Epichlorohydrin-ethylene oxide-allyl glycidyl ether ternary copolymer (GECO) (trade name: Epichlomer-CG-102 manufactured by Daiso Co., Ltd.) | 100 parts by mass |
| inc oxide (Zinc Oxide Two manufactured by Seido Chemical Industry Co., Ltd.) | 5 parts by mass |
| Calcium carbonate (trade name: Silver W manufactured by Shiraishi Calcium Kaisha, Ltd.) | 35 parts by mass |
| Carbon black (trade name: Seast SO manufactured by Tokai Carbon Co., Ltd.) | 0.5 parts by mass |
| Stearic acid | 2 parts by mass |
| Adipic acid ester (trade name: Polycizer W305ELS manufactured by DIC Corp.) | 10 parts by mass |
| Sulfur | 0.5 parts by mass |
| Dipentamethylene thiuram tetrasulfide (trade name: Nocceler TRA manufactured by Ouchi Shinko Chemical Industrial Co., Ltd.) | 2 parts by mass |
| Cetyltrimethylammonium bromide | 2 parts by mass |

Example 21

The electro-conductive roller was produced in the same way as in Example 19 except that the cetyltrimethylammonium bromide was changed to the ionic conductive agent 2. This electro-conductive roller was evaluated as an electrophotographic member in the same way as in Example 1. The evaluation results are shown in Table 14-1.

Examples 22 to 40

The electrophotographic members were produced in the same way as in Example 1 except that the type and amount of the ionic conductive agent added to the coating solution 1 were changed as shown in Tables 14-2, 14-3, 14-4 and 14-5. The electrophotographic members were evaluated in the same way as in Example 1. The evaluation results are shown in Tables 14-2, 14-3, 14-4 and 14-5.

Example 41

The electrophotographic member was produced in the same way as in Example 13 except that the ionic conductive agent added to the coating solution 2 was changed to the ionic conductive agent 21. The electrophotographic member was evaluated in the same way as in Example 1. The evaluation results are shown in Table 14-5.

Example 42

The electrophotographic member was produced in the same way as in Example 14 except that the ionic conductive agent added to the coating solution 3 was changed to the ionic conductive agent 21. The electrophotographic member was evaluated in the same way as in Example 1. The evaluation results are shown in Table 14-5.

Example 43

The electrophotographic member was produced in the same way as in Example 15 except that the ionic conductive agent for the coating solution 4 was changed to the ionic conductive agent 21. The electrophotographic member was evaluated in the same way as in Example 1. The evaluation results are shown in Table 14-5.

Example 44

The electrophotographic member was produced in the same way as in Example 16 except that the ionic conductive agent added to the coating solution 5 was changed to the ionic conductive agent 21. The electrophotographic member was evaluated in the same way as in Example 1. The evaluation results are shown in Table 14-5.

Example 45

The electrophotographic member was produced in the same way as in Example 17 except that the ionic conductive agent added to the coating solution 6 was changed to the ionic conductive agent 21. The electrophotographic member was evaluated in the same way as in Example 1. The evaluation results are shown in Table 14-5.

Example 46-47

The electrophotographic member was produced in the same way as in Example 1 except that the type of the ionic conductive agent added to the coating solution 1 were changed as shown in Table 14-5. The electrophotographic member was evaluated in the same way as in Example 1. The evaluation results are shown in Table 14-5.

Example 48

The electrophotographic member was produced in the same way as in Example 20 except that the ionic conductive agent added to the coating solution 1 was changed to the ionic conductive agent 21. The electrophotographic member was evaluated in the same way as in Example 1. The evaluation results are shown in Table 14-5.

Example 49-58

The electrophotographic members were produced in the same way as in Example 1 except that the type and amount of the ionic conductive agent added to the coating solution 1 were changed as shown in Tables 14-6 and 14-7. The electrophotographic members were evaluated in the same way as in Example 1. The evaluation results are shown in Tables 14-6 and 14-7.

Example 59

In order to prepare an inorganic film on the surface of the electrophotographic member produced in Example 1, the electro-conductive roller was dipped in coating solution 7 (trade name: Flessela manufactured by Panasonic Corp.) to form a film of the coating solution on the surface of the elastic layer in the electro-conductive roller. This film was dried and further heat-treated for 1 hour in an oven heated to a temperature of 140° C. to prepare so that an organic-inorganic hybrid surface layer was prepared to produce an electrophotographic member. The electrophotographic members were evaluated in the same way as in Example 1. The evaluation results are shown in Table 14-8.

Comparative Example 1

The electrophotographic member was produced in the same way as in Example 1 except that the ionic conductive agent was changed to 1-ethyl-3-methylimidazolium bistrifluoromethylsulfonylimide. The electrophotographic members were evaluated in the same way as in Example 1. The evaluation results are shown in Table 14-9.

Comparative Example 2

The electrophotographic member was produced in the same way as in Example 20 except that the ionic conductive agent was changed to 1-ethyl-3-methylimidazolium bistrifluoromethylsulfonylimide. The electrophotographic members were evaluated in the same way as in Example 1. The evaluation results are shown in Table 14-9.

Comparative Example 3

The electrophotographic member was produced in the same way as in Example 14 except that the ionic conductive agent was changed to choline bistrifluoromethylsulfonylimide. The electrophotographic members were evaluated in the same way as in Example 1. The evaluation results are shown in Table 14-9.

Comparative Example 4

The electrophotographic member was produced in the same way as in Example 14 except that the coating solution was changed to methoxymethylated nylon. The electrophotographic members were evaluated in the same way as in Example 1. The evaluation results are shown in Table 14-9.

TABLE 14-1

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Ionic conductive agent type | 1 | 2 | 3 | 4 | 5 | 6 | 7 | 8 | 9 | 10 |
| Partial structure | Formula (1) | Formula (1) | Formula (1) | Formula (1) | Formula (1) | Formula (1) | Formula (1) | Formula | Formula (1) (1) | Formula (1) |
| $R_{101}$ | H | H | H | H | H | H | H | H | H | H |
| $R_{102}$ | $C_2H_4$ | $C_4H_8$ | $C_4H_8$ | $C_8H_{16}$ | $C_8H_{16}$ | $C_{16}H_{32}$ | $C_4H_8$ | $C_4H_8$ | $C_4H_8$ | $C_4H_8$ |
| $R_{103}$ | Me | Me | Me | Me | Me | Me | — | — | — | — |
| $R_{104}$ | Me | Me | Me | Me | Me | Me | — | — | — | — |
| $R_{105}$ | Me | Me | Me | Me | Me | Me | — | — | — | — |
| $R_{106}$ | — | — | — | — | — | — | Me | — | — | — |
| n | — | — | — | — | — | — | 1 | — | — | — |
| B' | — | — | — | — | — | — | $CH_2$ | — | — | — |
| $R_{107}$ | — | — | — | — | — | — | — | Me | C4H9 | — |
| $R_{108}$ | — | — | — | — | — | — | — | H | Me | — |
| $R_{109}$ | — | — | — | — | — | — | — | — | — | n-Bu |
| Anion | Cl | TFSI | CHFSI | Bn | TFSI | TFSI | TFSI | TFSI | TFSI | TFSI |
| Amount of ionic conductive agent added (parts by mass) | 2 | 2 | 2 | 2 | 2 | 2 | 2 | 2 | 2 | 2 |
| Binder structure | EO/PO | EO/PO | EO/PO | EO/PO | EO/PO | EO/PO | EO/PO | EO/PO | EO/PO | EO/PO |
| Binding site structure | 8 | 8 | 8 | 8 | 8 | 8 | 8 | 8 | 8 | 8 |
| Elastic layer | NBR | NBR | NBR | NBR | NBR | NBR | NBR | NBR | NBR | NBR |
| Film resistance (Q · cm) | 8.7E+06 | 1.5E+06 | 3.0E+06 | 9.1E+06 | 1.2E+06 | 1.1E+06 | 2.0E+06 | 1.1E+06 | 1.5E+06 | 1.7E+06 |
| Bleeding test | B | B | B | B | B | B | B | B | B | B |
| Roller resistance value variation | 1.38 | 1.24 | 1.12 | 1.38 | 1.22 | 1.23 | 1.21 | 1.24 | 1.24 | 1.28 |
| Continuous image output durability | B | A | A | B | A | A | A | A | A | A |

| | Example 11 | Example 12 | Example 13 | Example 14 | Example 15 | Example 16 | Example 17 | Example 18 | Example 19 | Example 20 | Example 21 |
|---|---|---|---|---|---|---|---|---|---|---|---|
| Ionic conductive agent type | 11 | 12 | 2 | 2 | 2 | 2 | 2 | 2 | 2 | 2 | 2 |
| Partial structure | Formula (1) | Formula (1) | Formula (1) | Formula (1) | Formula (1) | Formula (1) | Formula (1) | Formula (1) | Formula (1) | Formula (1) | Formula (1) |
| $R_{101}$ | Me | Me | H | H | H | H | H | H | H | H | H |
| $R_{102}$ | $C_4H_8$ | $(C_2H_4O)_8C_2H_4$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ |
| $R_{103}$ | n-Bu | n-Bu | Me | Me | Me | Me | Me | Me | Me | Me | Me |
| $R_{104}$ | n-Bu | n-Bu | Me | Me | Me | Me | Me | Me | Me | Me | Me |
| $R_{105}$ | n-Bu | n-Bu | Me | Me | Me | Me | Me | Me | Me | Me | Me |
| $R_{106}$ | — | — | — | — | — | — | — | — | — | — | — |
| n | — | — | — | — | — | — | — | — | — | — | — |
| B' | — | — | — | — | — | — | — | — | — | — | — |
| $R_{107}$ | — | — | — | — | — | — | — | — | — | — | — |
| $R_{108}$ | — | — | — | — | — | — | — | — | — | — | — |
| $R_{109}$ | — | — | — | — | — | — | — | — | — | — | — |
| Anion | TFSI | TFSI | TFSI | TFSI | TFSI | TFSI | TFSI | TFSI | TFSI | TFSI | TFSI |
| Amount of ionic conductive agent added (parts by mass) | 2 | 2 | 2 | 2 | 2 | 2 | 2 | 0.5 | 5 | 2 | 2 |

TABLE 14-1-continued

| | | | | | | | | | | | |
|---|---|---|---|---|---|---|---|---|---|---|---|
| Binder structure | EO/PO | EO/PO | Ester | EO/PO | EO/PO | EO/BO | PO/BO | EO/PO | EO/PO | EO/PO | EO/EP |
| Binding site structure | 8 | 8 | 8 | 9 | 10 | 8 | 8 | 8 | 8 | 8 | 11 |
| Elastic layer | NBR | NBR | NBR | NBR | NBR | NBR | NBR | NBR | NBR | Epichloro-hydrin | Epichloro-hydrin |
| Film resistance (Ω · cm) | 1.7E+06 | 7.8E+05 | 9.5E+06 | 1.30E+06 | 8.50E+06 | 1.90E+06 | 3.80E+06 | 5.60E+06 | 5.20E+05 | 3.10E+06 | 3.50E+06 |
| Bleeding test | B | B | B | B | B | B | B | B | B | B | B |
| Roller resistance value variation | 1.23 | 1.24 | 1.35 | 1.25 | 1.39 | 1.23 | 1.28 | 1.34 | 1.05 | 1.3 | 1.31 |
| Continuous image output durability | A | A | B | A | B | A | A | B | A | B | B |

TABLE 14-2

| | Example 22 | Example 23 | Example 24 |
|---|---|---|---|
| Ionic conductive agent type | 13 | 14 | 15 |
| Partial structure | Formula (2) | Formula (2) | Formula (2) |
| $R_{201}$ | H | H | H |
| $R_{202}$ | H | H | H |
| $R_{203}$ | $C_2H_4$ | $C_8H_{16}$ | $C_4H_8$ |
| $R_{204}$ | $C_2H_4$ | $C_8H_{16}$ | $C_4H_8$ |
| $R_{205}$ | Me | Bu | — |
| $R_{206}$ | Me | Bu | — |
| n | — | — | 2 |
| D | — | — | O |
| Anion | TFSI | TFSI | TFSI |
| Amount of ionic conductive agent added (parts by mass) | 2 | 2 | 2 |
| Binder structure | EO/PO | EO/PO | EO/PO |
| Binding site structure | 8 | 8 | 8 |
| Elastic layer | NBR | NBR | NBR |
| Film resistance (Ω · cm) | 3.3E+06 | 2.7E+06 | 3.0E+06 |
| Bleeding test | A | A | A |
| Roller resistance value variation | 1.8 | 1.15 | 1.16 |
| Continuous image output durability | A | A | A |

TABLE 14-3

| | Example 25 | Example 26 |
|---|---|---|
| Ionic conductive agent type | 16 | 17 |
| Partial structure | Formula (3) | Formula (3) |
| $R_{301}$ | H | H |
| $R_{302}$ | H | H |
| $R_{303}$ | H | H |
| $R_{304}$ | $C_3H_6$ | $(C_2H_4O)_2C_2H_4$ |
| $R_{305}$ | $C_3H_6$ | $(C_2H_4O)_2C_2H_4$ |
| $R_{306}$ | $C_3H_6$ | $(C_2H_4O)_2C_2H_4$ |
| $R_{307}$ | Me | Bu |
| Anion | TFSI | TFSI |
| Amount of ionic conductive agent added (parts by mass) | 2 | 2 |

TABLE 14-3-continued

| | Example 25 | Example 26 |
|---|---|---|
| Binder structure | EO/PO | EO/PO |
| Binding site structure | 8 | 8 |
| Elastic layer | NBR | NBR |
| Film resistance (Ω · cm) | 4.0E+06 | 3.5E+06 |
| Bleeding test | A | A |
| Roller resistance value variation | 1.1 | 1.09 |
| Continuous image output durability | A | A |

TABLE 14-4

| | Example 27 | Example 28 |
|---|---|---|
| Ionic conductive agent type | 18 | 19 |
| Partial structure | Formula (4) | Formula (4) |
| $R_{401}$ | H | H |
| $R_{402}$ | H | H |
| $R_{403}$ | H | H |
| $R_{404}$ | H | H |
| $R_{405}$ | $C_2H_4$ | $(C_2H_4O)_2C_2H_4$ |
| $R_{406}$ | $C_2H_4$ | $(C_2H_4O)_2C_2H_4$ |
| $R_{407}$ | $C_2H_4$ | $(C_2H_4O)_2C_2H_4$ |
| $R_{408}$ | $C_2H_4$ | $(C_2H_4O)_2C_2H_4$ |
| Anion | TFSI | TFSI |
| Amount of ionic conductive agent added (parts by mass) | 2 | 2 |
| Binder structure | EO/PO | EO/PO |
| Binding site structure | 8 | 8 |
| Elastic layer | NBR | NBR |
| Film resistance (Ω · cm) | 5.0E+06 | 4.5E+06 |
| Bleeding test | A | A |
| Roller resistance value variation | 1.05 | 1.03 |
| Continuous image output durability | B | A |

TABLE 14-5

| | Example 29 | Example 30 | Example 31 | Example 32 | Example 33 | Example 34 | Example 35 | Example 36 | Example 37 | Example 38 |
|---|---|---|---|---|---|---|---|---|---|---|
| Ionic conductive agent type | 20 | 21 | 22 | 23 | 24 | 25 | 26 | 27 | 28 | 29 |
| Partial structure | Formula (5) | Formula (5) | Formula (5) | Formula (5) | Formula (5) | Formula (5) | Formula (5) | Formula (5) | Formula (5) | Formula (5) |

TABLE 14-5-continued

| | | | | | | | | | | |
|---|---|---|---|---|---|---|---|---|---|---|
| $R_{501}$ | H | H | H | H | H | H | H | H | H | H |
| $R_{502}$ | H | H | H | H | H | H | H | H | H | H |
| $R_{503}$ | $C_2H_4$ | $C_4H_8$ | $C_4H_8$ | $C_8H_{16}$ | $C_4H_8$ | $C_{16}H_{32}$ | $(C_2H_4O)_2C_2H_4$ | $C_8H_{16}$ | $C_4H_8$ | $C_{12}H_{24}$ |
| $R_{504}$ | $C_2H_4$ | $C_4H_8$ | $C_4H_8$ | $C_8H_{16}$ | $C_4H_8$ | $C_{16}H_{32}$ | $(C_2H_4O)_2C_2H_4$ | $C_8H_{16}$ | $C_4H_8$ | $C_{12}H_{24}$ |
| $R_{505}$ | $C_2H_4$ | $C_4H_8$ | $C_4H_8$ | $C_8H_{16}$ | $C_{16}H_{32}$ | $C_{16}H_{32}$ | $(C_2H_4O)_2C_2H_4$ | $C_8H_{16}$ | $C_4H_8$ | $C_{12}H_{24}$ |
| G | N | N | N | N | N | N | N | N | N | N |
| $R_{506}$ | Bu | Me | Me | Me | Me | Me | Me | — | — | — |
| $R_{507}$ | Bu | Me | Me | Me | Me | Me | Me | — | — | — |
| $R_{508}$ | Bu | Me | Me | $C_{18}H_{37}$ | Me | Me | Me | — | — | — |
| $R_{509}$ | — | — | — | — | — | — | — | Et | — | — |
| n | — | — | — | — | — | — | — | 2 | — | — |
| H' | — | — | — | — | — | — | — | O | — | — |
| $R_{510}$ | — | — | — | — | — | — | — | — | Me | Et |
| $R_{511}$ | — | — | — | — | — | — | — | — | H | H |
| $R_{512}$ | — | — | — | — | — | — | — | — | — | — |
| Anion | TFSI | TFSI | CHFSI | TFSI | TFSI | TFSI | TFSI | TFSI | TFSI | TFSI |
| Amount of ionic conductive agent added (parts by mass) | 2 | 2 | 2 | 2 | 2 | 2 | 2 | 2 | 2 | 2 |
| Binder structure | EO/PO | EO/PO | EO/PO | EO/PO | EO/PO | EO/PO | EO/PO | EO/PO | EO/PO | EO/PO |
| Binding site structure | 8 | 8 | 8 | 8 | 8 | 8 | 8 | 8 | 8 | 8 |
| Elastic layer | NBR | NBR | NBR | NBR | NBR | NBR | NBR | NBR | NBR | NBR |
| Film resistance (Ω · cm) | 2.0E+06 | 1.7E+06 | 2.2E+06 | 1.6E+06 | 1.4E+06 | 1.3E+06 | 1.1E+06 | 2.5E+06 | 1.3E+06 | 1.5E+06 |
| Bleeding test | A | A | A | A | A | A | A | A | A | A |
| Roller resistance value variation | 1.07 | 1.07 | 1.05 | 1.08 | 1.08 | 1.08 | 1.08 | 1.07 | 1.05 | 1.06 |
| Continuous image output durability | A | A | A | A | A | A | A | A | A | A |

| | Example 39 | Example 40 | Example 41 | Example 42 | Example 43 | Example 44 | Example 45 | Example 46 | Example 47 | Example 48 |
|---|---|---|---|---|---|---|---|---|---|---|
| Ionic conductive agent type | 30 | 31 | 21 | 21 | 21 | 21 | 21 | 21 | 21 | 21 |
| Partial structure | Formula (5) | Formula (5) | Formula (5) | Formula (5) | Formula (5) | Formula (5) | Formula (5) | Formula (5) | Formula (5) | Formula (5) |
| $R_{501}$ | H | H | H | H | H | H | H | H | H | H |
| $R_{502}$ | H | H | H | H | H | H | H | H | H | H |
| $R_{503}$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ |
| $R_{504}$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ |
| $R_{505}$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ | $C_4H_8$ |
| G | N | N | N | N | N | N | N | N | N | N |
| $R_{506}$ | — | — | Me | Me | Me | Me | Me | Me | Me | Me |
| $R_{507}$ | — | — | Me | Me | Me | Me | Me | Me | Me | Me |
| $R_{508}$ | — | — | Me | Me | Me | Me | Me | Me | Me | Me |
| $R_{509}$ | — | — | — | — | — | — | — | Et | — | — |
| n | — | — | — | — | — | — | — | 2 | — | — |
| H' | — | — | — | — | — | — | — | O | — | — |
| $R_{510}$ | Bu | — | — | — | — | — | — | — | Me | Et |
| $R_{511}$ | Me | — | — | — | — | — | — | — | H | H |
| $R_{512}$ | — | 3-Bu | — | — | — | — | — | — | — | — |
| Anion | TFSI | TFSI | TFSI | TFSI | TFSI | TFSI | TFSI | TFSI | TFSI | TFSI |
| Amount of ionic conductive agent added (parts by mass) | 2 | 2 | 2 | 2 | 2 | 2 | 2 | 0.5 | 5 | 2 |
| Binder structure | EO/PO | EO/PO | Ester | EO/PO | EO/PO | EO/BO | PO/BO | EO/PO | EO/PO | EO/PO |
| Binding site structure | 8 | 8 | 8 | 8 | 8 | 8 | 8 | 8 | 8 | 8 |
| Elastic layer | NBR | NBR | NBR | NBR | NBR | NBR | NBR | NBR | NBR | Hydrin |
| Film resistance (Ω · cm) | 1.5E+06 | 2.1E+06 | 9.3E+06 | 1.5E+06 | 8.4E+06 | 1.3E+06 | 3.9E+06 | 5.3E+06 | 5.8E+06 | 3.3E+06 |
| Bleeding test | A | A | A | A | A | A | A | A | A | A |
| Roller resistance value variation | 1.06 | 1.09 | 1.32 | 1.06 | 1.37 | 1.06 | 1.15 | 1.24 | 1.03 | 1.11 |
| Continuous image output durability | A | A | B | A | B | A | A | A | A | A |

TABLE 14-6

| | Example 49 | Example 50 | Example 51 | Example 52 | Example 53 | Example 54 | Example 55 |
|---|---|---|---|---|---|---|---|
| Ionic conductive agent type | 32 | 33 | 34 | 35 | 36 | 37 | 38 |
| Partial structure | Formula (6) | Formula (6) | Formula (6) | Formula (6) | Formula (6) | Formula (6) | Formula (6) |
| $R_{601}$ | H | H | H | H | H | H | H |
| $R_{602}$ | H | H | H | H | H | H | H |
| $R_{603}$ | H | H | H | H | H | H | H |
| $R_{604}$ | $C_2H_4$ | $C_8H_{16}$ | $(C_2H_4O)_2C_2H_4$ | $C_2H_4$ | $C_2H_4$ | $C_8H_{16}$ | $C_4H_8$ |
| $R_{605}$ | $C_2H_4$ | $C_8H_{16}$ | $(C_2H_4O)_2C_2H_4$ | $C_2H_4$ | $C_2H_4$ | $C_8H_{16}$ | $C_4H_8$ |
| $R_{606}$ | $C_2H_4$ | $C_8H_{16}$ | $(C_2H_4O)_2C_2H_4$ | $C_2H_4$ | $C_2H_4$ | $C_8H_{16}$ | $C_4H_8$ |
| $R_{607}$ | $C_2H_4$ | $C_8H_{16}$ | $(C_2H_4O)_2C_2H_4$ | $C_2H_4$ | $C_2H_4$ | $C_8H_{16}$ | $C_4H_8$ |
| I' | N+ | N+ | N+ | N+ | N+ | N+ | N+ |
| $R_{608}$ | Me | Hex | Bu | Me | Me | Me | Me |
| $R_{609}$ | Me | Hex | Bu | Me | Me | Me | Me |
| $R_{610}$ | Me | Hex | Bu | — | — | — | — |
| $R_{611}$ | — | — | — | Me | — | — | — |
| n | — | — | — | 1 | — | — | — |
| K' | — | — | — | $CH_2$ | — | — | — |
| $R_{612}$ | — | — | — | — | Me | Bu | — |
| $R_{613}$ | — | — | — | — | H | Me | — |
| $R_{614}$ | — | — | — | — | — | — | H |
| Anion | TFSI | TFSI | CHFSI | TFSI | TFSI | TFSI | TFSI |
| Amount of ionic conductive agent added (parts by mass) | 2 | 2 | 2 | 2 | 0.5 | 5 | 2 |
| Binder structure | EO/PO | EO/PO | EO/PO | EO/PO | EO/PO | EO/PO | EO/PO |
| Binding site structure | 8 | 8 | 8 | 8 | 8 | 8 | 8 |
| Elastic layer | NBR | NBR | NBR | NBR | NBR | NBR | NBR |
| Film resistance (Ω · cm) | 2.5E+06 | 2.0E+06 | 1.4E+06 | 2.9E+06 | 2.3E+06 | 1.8E+06 | 2.7E+06 |
| Bleeding test | A | A | A | A | A | A | A |
| Roller resistance value variation | 1.05 | 1.05 | 1.04 | 1.07 | 1.04 | 1.05 | 1.07 |
| Continuous image output durability | A | A | A | A | A | A | A |

TABLE 14-7

| | Example 56 | Example 57 | Example 58 |
|---|---|---|---|
| Ionic conductive agent type | 39 | 40 | 41 |
| Partial structure | Formula (7) | Formula (7) | Formula (7) |
| $R_{701}$ | H | H | H |
| $R_{702}$ | H | H | H |
| $R_{703}$ | H | H | H |
| $R_{704}$ | H | H | H |
| $R_{705}$ | $C_2H_4$ | $C_8H_{16}$ | $C_4H_8$ |
| $R_{706}$ | $C_2H_4$ | $C_8H_{16}$ | $C_4H_8$ |
| $R_{707}$ | $C_2H_4$ | $C_8H_{16}$ | $C_4H_8$ |
| $R_{708}$ | $C_2H_4$ | $C_8H_{16}$ | $C_4H_8$ |
| $R_{709}$ | $C_2H_4$ | $C_8H_{16}$ | $C_4H_8$ |
| $R_{710}$ | $C_2H_4$ | $C_8H_{16}$ | $C_4H_8$ |
| L, L' | N | N | N |
| $R_{711}$ | Me | Bu | — |
| $R_{712}$ | Me | Bu | — |
| n | — | — | 2 |
| P' | — | — | O |
| Anion | TFSI | TFSI | TFSI |
| Amount of ionic conductive agent added (parts by mass) | 2 | 3 | 4 |
| Binder structure | EO/PO | EO/PO | EO/PO |
| Binding site structure | 8 | 8 | 8 |
| Elastic layer | NBR | NBR | NBR |
| Film resistance (Ω · cm) | 5.0E+06 | 4.2E+06 | 4.6E+06 |
| Bleeding test | A | A | A |
| Roller resistance value variation | 1.04 | 1.04 | 1.05 |
| Continuous image output durability | A | A | A |

TABLE 14-8

| | Example 59 |
|---|---|
| Ionic conductive agent type | 2 |
| Partial structure | Formula (1) |
| $R_{101}$ | H |
| $R_{102}$ | $C_4H_8$ |
| $R_{103}$ | Me |
| $R_{104}$ | Me |
| $R_{105}$ | Me |
| $R_{106}$ | — |
| n | — |
| B' | — |
| $R_{107}$ | — |
| $R_{108}$ | — |
| $R_{109}$ | — |
| Anion | TFSI |
| Amount of ionic conductive agent added (parts by mass) | 2 |
| Binder structure | EO/PO |
| Binding site structure | 8 |
| Elastic layer | NBR |
| Film resistance (Ω · cm) | 1.5E+06 |
| Bleeding test | A |
| Roller resistance value variation | 1.32 |
| Continuous image output durability | A |

TABLE 14-9

| | Comparative Example 1 | Comparative Example 2 | Comparative Example 3 | Comparative Example 4 |
|---|---|---|---|---|
| Ionic conductive agent type | 1-Et-3-Me-imidazolium | 1-Et-3-Me-imidazolium | Choline | 1-Et-3-Me-imidazolium |
| Anion | TFSI | TFSI | TFSI | TFSI |
| Amount of ionic conductive agent added (parts by mass) | 2 | 2 | 2 | 2 |
| Binder structure | EO/PO | EO/PO | EO/PO | Polyamide |
| Elastic layer | NBR | Hydrin | NBR | NBR |
| Film resistance (Ω · cm) | 9.7E+05 | 1.5E+06 | 1.3E+06 | 8.6E+06 |
| Bleeding test | D | D | D | D |
| Roller resistance value variation | 1.6 | 1.6 | 1.7 | 1.8 |
| Continuous image output durability | C | C | D | D |

When Examples having the configuration of the present invention are compared with Comparative Example 1, the samples of Examples are found to produce good results in the bleeding test and be excellent in roller resistance value variation and continuous image output durability. This is probably because the quaternary ammonium salt was anchored to the binder resin via the structure of the present invention.

As for the influence of the partial structure according to Examples, a larger number of nitrogen atoms bonded to the binder resin tends to suppress bleeding and change in electro-conductivity caused by electrification. This is probably because the quaternary ammonium salt is more firmly anchored in the binder resin. As for the electro-conductivity, a partial structure containing the quaternary ammonium salt structure in the binder resin side chain tends to exhibit higher electro-conductivity than that of a partial structure containing the quaternary ammonium salt structure in the binder resin backbone. This is probably due to the high mobility of the quaternary ammonium salt structure. Specifically, the structure of the formula (5) or (6) in which a plurality of nitrogen atoms are bonded to the binder resin and the quaternary ammonium salt structure is present in the binder resin side chain can suppress bleeding and change in electro-conductivity caused by electrification while maintaining high electro-conductivity.

The perfluorosulfonylimide anion selected as the anion according to Examples tends to further lower resistance and improve continuous image output durability. Thus, the anion species can be a perfluorosulfonylimide anion.

The binder resin according to Examples having an alkylene oxide group in its structure promotes ion dissociation and therefore tends to further lower resistance and improve continuous image output durability. Thus, the binder resin can have an alkylene oxide structure.

Example 60

A cored bar made of SUS (stainless steel) was provided with nickel, further coated with an adhesive, and baked, and the obtained product was used as an electro-conductive mandrel. This cored bar was placed in a die and mixed with each material of type and amount shown in Table 16 below in the apparatus. Then, the mixture was injected to a cavity formed in the die preheated to 120° C. Subsequently, the die was heated to 120° C. The liquid silicone rubber was vulcanized, cured, cooled and demolded to obtain electro-conductive elastic roller of 12 mm in diameter made of silicone rubber. Then, the ends of the electro-conductive layer were cut off such that the length of the electro-conductive layer in the axial direction of the cored bar was 228 mm.

TABLE 16

| Material | Usage (parts by mass) |
|---|---|
| Liquid silicone rubber (trade name: SE6724A/B manufactured by Toray Dow Corning Co., Ltd.) | 100 |
| Carbon black (trade name: Toka Black #7360SB manufactured by Tokai Carbon Co., Ltd.) | 35 |
| Silica powder | 0.2 |
| Platinum catalyst | 0.1 |

The electrophotographic member of Example 60 was obtained in the same way as in Example 1 except that the electro-conductive elastic roller used in Example 1 was changed to this electro-conductive roller made of silicone rubber.

Next, the produced electrophotographic member was subjected as a developing roller to the following evaluation tests.

<Electrical Resistivity Measurement of Electro-Conductive Layer>

Evaluation was conducted in the same way as in Example 1. The evaluation results are shown in Table 17-1.

<Bleeding Test>

Evaluation was conducted in the same way as in Example 1 except that the prepared electrophotographic member was incorporated as a developing roller. The evaluation results are shown in Table 17-1.

<Evaluation of Roller Resistance Value Variation>

Evaluation was conducted in the same way as in Example 1. The evaluation results are shown in Table 17-1.

<Image Evaluation>

<Evaluation of Image Density Durability (Degradation Caused by Electrification)>

In order to evaluate weak image density resulting from degradation caused by electrification of a developing roller in a low-temperature and low-humidity environment, the prepared electro-conductive roller was left for 1 month in an environment having a temperature of 15° C. and a humidity of 10% R.H. (L/L). In this L/L environment, a cartridge for a color laser printer (trade name: Color LaserJet CP2025dn, manufactured by Hewlett-Packard Development Company, L.P.) was subsequently equipped with this electro-conductive roller as a developing roller, and 1 image having a coverage rate of 100% was output. The toner used was magenta toner preinstalled in the cartridge. Then, the developing roller was taken out of the cartridge, and the toner on the surface of the developing roller was removed with air. Then, the jig for degradation caused by electrification illustrated in FIGS. 4A and 4B was placed therein. A direct voltage of −200 V was applied for 30 minutes at the same time with the rotation of the cylindrical metal 42 at 30 rpm. The developing roller thus degraded by electrification was incorporated again in the cartridge, and 1 image having a coverage rate of 100% was output. This series of procedures were all carried out in the L/L environment.

The reflected densities of the obtained images before and after the degradation caused by electrification were measured using a reflection-type densitometer (trade name: TC-6DS/A; manufactured by Tokyo Denshoku Co., Ltd.). An arithmetic average of the reflected densities at 10 sites measured on each image was used as an image density value.

The difference of image density between before the degradation caused by electrification and after the degradation caused by electrification was determined according to the following formula, and evaluation was conducted according to criteria given below.

Difference of image density=|Density before degradation caused by electrification−Density after degradation caused by electrification|

The evaluation results are shown in Table 17-1.

A: Less than 0.05

B: 0.05 or more and less than 0.10

C: 0.10 or more and 0.20 or less

D: More than 0.20

Comparative Example 5

The electrophotographic member was produced in the same way as in Comparative Example 1 except that the elastic roller was changed to the electro-conductive roller made of silicone rubber of Example 60. The electrophotographic member was evaluated in the same way as in Example 60. The evaluation results are shown in Table 17-2.

TABLE 17-1

| | Example 60 |
|---|---|
| Ionic conductive agent type | 2 |
| Partial structure | Formula (1) |
| $R_{101}$ | H |
| $R_{102}$ | $C_4H_8$ |
| $R_{103}$ | Me |
| $R_{104}$ | Me |
| $R_{105}$ | Me |
| $R_{106}$ | — |
| n | — |
| B' | — |
| $R_{107}$ | — |
| $R_{108}$ | — |
| $R_{109}$ | — |
| Anion | TFSI |
| Amount of ionic conductive agent added (parts by mass) | 2 |
| Binder structure | EO/PO |
| Binding site structure | 8 |
| Elastic layer | Silicone |
| Film resistance (Ω · cm) | 1.5E+06 |
| Bleeding test | A |
| Roller resistance value variation | 1.07 |
| Continuous image output durability | A |

TABLE 17-2

| | Comparative Example 5 |
|---|---|
| Ionic conductive agent type | 1-Et-3-Me-imidazolium |
| Anion | TFSI |
| Amount of ionic conductive agent added (parts by mass) | 2 |
| Binder structure | EO/PO |
| Elastic layer | Silicone |
| Film resistance (Ω · cm) | 9.7E+05 |
| Bleeding test | D |
| Roller resistance value variation | 1.7 |
| Continuous image output durability | D |

When Example 60 having the configuration of the present invention is compared with Comparative Example 5 in which the ionic conductive agent was not anchored, the sample of Example 60 is found to produce good results in the bleeding test and be excellent in roller resistance value variation and image density durability. This is probably because the quaternary ammonium salt was anchored to the binder resin via the structure of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-101637, filed May 15, 2014, which is hereby incorporated by reference herein in its entirety.

What is claimed is:

1. An electrophotographic member comprising an electro-conductive mandrel and an electro-conductive layer, wherein the electro-conductive layer comprises an anion and a polymeric binder resin having at least one partial structure selected from the group consisting of partial structures represented by formulae (1) to (7) in a molecule of the polymeric binder resin:

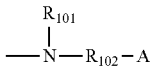

(1)

wherein $R_{101}$ represents a hydrogen atom or an alkyl group having 1 to 3 carbon atoms, $R_{102}$ represents $C_mH_{2m}$ (wherein m is 2 to 16) or $(C_2H_4O)_lC_2H_4$ (wherein l is 1 to 8), and A represents the following structural formula:

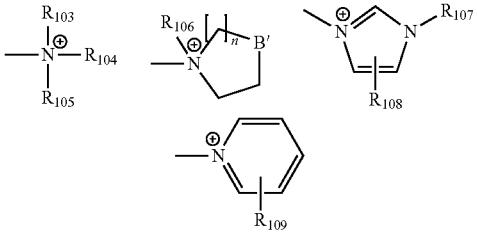

wherein $R_{103}$ to $R_{109}$ each independently represent an alkyl group having 1 to 18 carbon atoms, n represents 1 or 2, and B' represents a methylene group or an oxygen atom;

(2)

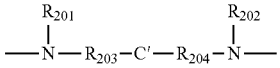

wherein $R_{201}$ and $R_{202}$ each independently represent a hydrogen atom or an alkyl group having 1 to 3 carbon atoms, $R_{203}$ and $R_{204}$ each independently represent $C_mH_{2m}$ (wherein m is 2 to 16) or $(C_2H_4O)_1C_2H_4$ (wherein 1 is 1 to 8), and C' represents the following structural formula:

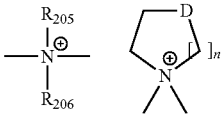

wherein $R_{205}$ and $R_{206}$ each independently represent an alkyl group having 1 to 18 carbon atoms, n represents 1 or 2, and D represents a methylene group or an oxygen atom;

(3)

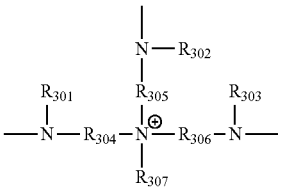

wherein $R_{301}$ to $R_{303}$ each independently represent a hydrogen atom or an alkyl group having 1 to 3 carbon atoms, $R_{304}$ to $R_{306}$ each independently represent $C_mH_{2m}$ (wherein m is 2 to 16) or $(C_2H_4O)_LC_2H_4$ (wherein 1 is 1 to 8), and $R_{307}$ represents an alkyl group having 1 to 18 carbon atoms;

(4)

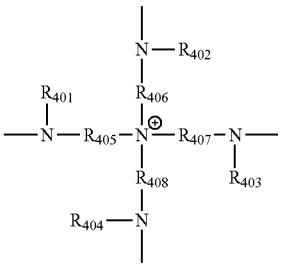

wherein $R_{401}$ to $R_{404}$ each independently represent a hydrogen atom or an alkyl group having 1 to 3 carbon atoms, and $R_{405}$ to $R_{408}$ each independently represent $C_mH_{2m}$ (wherein m is 2 to 16) or $(C_2H_4O)_1C_2H_4$ (wherein 1 is 1 to 8);

(5)

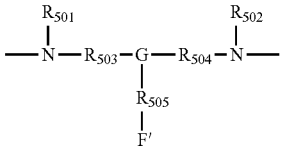

wherein $R_{501}$ and $R_{502}$ each independently represent a hydrogen atom or an alkyl group having 1 to 3 carbon atoms, $R_{503}$ to $R_{505}$ each independently represent $C_mH_{2m}$ (wherein m is 2 to 16) or $(C_2H_4O)_LC_2H_4$ (wherein 1 is 1 to 8), G represents a nitrogen atom or a methine group, and F' represents the following structural formula:

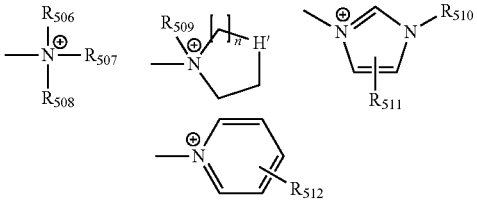

wherein $R_{506}$ to $R_{512}$ each independently represent an alkyl group having 1 to 18 carbon atoms, n represents 1 or 2, and H' represents a methylene group or an oxygen atom;

(6)

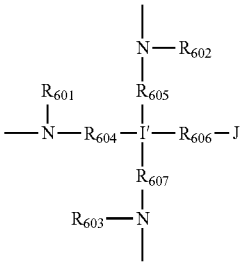

wherein $R_{601}$ to $R_{603}$ each independently represent a hydrogen atom or an alkyl group having 1 to 3 carbon atoms, $R_{604}$ to $R_{607}$ each independently represent $C_mH_{2m}$ (wherein m is 2 to 16) or $(C_2H_4O)_1C_2H_4$ (wherein 1 is 1 to 8), I' represents a nitrogen cation or a carbon atom, and J represents the following structural formula:

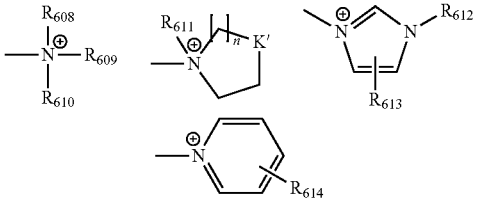

wherein $R_{608}$ to $R_{614}$ each independently represent an alkyl group having 1 to 18 carbon atoms, n represents 1 or 2, and K' represents a methylene group or an oxygen atom; and (7)

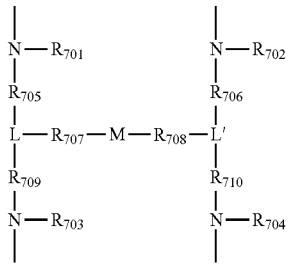

wherein $R_{701}$ to $R_{704}$ each independently represent a hydrogen atom or an alkyl group having 1 to 3 carbon atoms, $R_{705}$ to $R_{710}$ each independently represent $C_mH_{2m}$ (wherein m is 2 to 16) or $(C_2H_4O)_1C_2H_4$ (wherein 1 is 1 to 8), L and L' each represent a nitrogen atom or a methine group, and M represents the following structural formula:

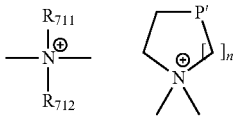

wherein $R_{711}$ and $R_{712}$ each independently represent an alkyl group having 1 to 16 carbon atoms, n represents 1 or 2, and P' represents a methylene group or an oxygen atom.

2. The electrophotographic member according to claim 1, wherein the partial structure represented by formulae (1) to (7) is bonded to a molecular chain of the polymeric binder resin via a structure represented by formulae (8) or (9):

(8)

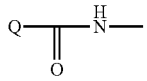

(9)

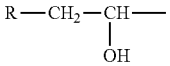

wherein Q and R each independently represent any of the structures of formulae (1) to (7).

3. The electrophotographic member according to claim 1, wherein the polymeric binder resin has an alkylene oxide structure.

4. The electrophotographic member according to claim 1, wherein anion in the electro-conductive layer comprises a perfluorosulfonylimide anion.

* * * * *